US007751766B2

(12) United States Patent
Tsunoda

(10) Patent No.: US 7,751,766 B2
(45) Date of Patent: Jul. 6, 2010

(54) FIXING DEVICE AND IMAGE FORMING APPARATUS HAVING THE SAME

(75) Inventor: Shigeru Tsunoda, Tokyo (JP)

(73) Assignee: Oki Data Corporation, Gunma (JP)

( * ) Notice: Subject to any disclaimer, the term of this patent is extended or adjusted under 35 U.S.C. 154(b) by 170 days.

(21) Appl. No.: 11/819,589

(22) Filed: Jun. 28, 2007

(65) Prior Publication Data

US 2008/0003025 A1 Jan. 3, 2008

(30) Foreign Application Priority Data

Jun. 29, 2006 (JP) ..... 2006-179009

(51) Int. Cl.
*G03G 15/20* (2006.01)

(52) U.S. Cl. ..... 399/322

(58) Field of Classification Search ..... 399/330, 399/331, 322, 122

See application file for complete search history.

(56) References Cited

U.S. PATENT DOCUMENTS 6,484,009 B2 * 11/2002 Furuya et al. ..... 399/333

FOREIGN PATENT DOCUMENTS

JP 2002-091217 3/2002

* cited by examiner

*Primary Examiner*—David M Gray
*Assistant Examiner*—Gregory H Curran
(74) *Attorney, Agent, or Firm*—Kubotera & Associates LLC

(57) ABSTRACT

A fixing device includes a fixing member for heating a recording medium and fixing an image formed on the recording medium; a pressing member pressed against the fixing member for pressing the recording medium against the fixing member; a frame member for supporting the fixing member and the pressing member; a cover member for covering the frame member; and a discharging member for discharging static electricity accumulated on the recording medium. The discharging member is sandwiched and held between the cover member and the frame member.

15 Claims, 25 Drawing Sheets

FIXING DEVICE AND IMAGE FORMING APPARATUS HAVING THE SAME

BACKGROUND OF THE INVENTION AND RELATED ART STATEMENT

The present invention relates to a fixing device and an image forming apparatus having the fixing device.

In an image forming apparatus such as a printer, a copier, a facsimile, and an MFP (Multifunction Peripheral), an image is formed on a recording medium through the following process. First, a charge roller charges a surface of a photosensitive drum. An exposure device such as an LED (light emitting diode) head exposes the surface of the photosensitive drum to form a static latent image or a latent image thereon. A developing roller attaches a thin layer of toner to the static latent image to form a toner image. A transfer roller transfers the toner image to the recording medium. A fixing unit or fixing device fixes the toner image to the recording medium before the recording medium is discharged outside the fixing device.

In the fixing device, a pressing roller is pressed against a fixing roller to form a nip portion therebetween. When the recording medium passes through the nip portion after the toner image is transferred thereto, the toner image is heated and pressed, thereby fixing the toner image to the recording medium. The fixing roller and the pressing roller are coated with a fluorine resin layer, so that toner is not easily stick thereto. Accordingly, when the recording medium passes through the nip portion, the recording medium tends to be statically charged through friction.

When the recording medium is discharged from the fixing device in a charged state, it is difficult to properly transport the recording medium due to the static charge on the recording medium. To this end, there has been proposed a fixing device having a discharging brush as a discharging member for discharging a recording medium (refer to Patent Reference). The discharging brush is arranged to contact with the recording medium when the recording medium passes through the nip portion.

In the conventional fixing device disclosed in Patent Reference, there is disclosed no specific attaching member for attaching the discharging brush to the fixing device. Instead of a specific attaching member, the discharging brush is attached to a brush supporting member with one side of a conductive double-sided adhesive tape, and is attached to a metal plate frame with the other side of the conductive double-sided adhesive tape. The metal plate frame is grounded and supports the fixing roller and the pressing roller. The discharging brush contacts with a surface of the recording medium, thereby removing electric charges on the surface of the recording medium.

Patent Reference Japanese Patent Publication No. 2002-91217

In the conventional fixing device, the metal plate frame has high heat conductivity. Accordingly, the metal plate frame easily receives heat from the fixing device, and tends to become very hot during an operation of the fixing device. As a result, a temperature of the conductive double-sided adhesive tape attaching the discharging brush increases, so that the conductive double-sided adhesive tape may come off. Consequently, it is difficult to properly contact the discharging brush with the metal plate frame, thereby making it difficult to stably discharge the recording medium with the discharging brush.

In view of the problems described above, an object of the present invention is to provide a fixing device and an image forming apparatus capable of solving the problems of the conventional fixing device. In the fixing device, a discharging member is sandwiched and held between a frame member and a cover member. The frame member supports a fixing member and a pressing member, and the cover member covers the frame member. Accordingly, it is possible to securely ground the discharging member without causing poor electric conductivity, thereby making it possible to stably discharge a recording medium and transport the recording medium.

Further objects and advantages of the invention will be apparent from the following description of the invention.

SUMMARY OF THE INVENTION

In order to attain the objects described above, according to the present invention, a fixing device comprises a fixing member for heating a recording medium and fixing an image formed on the recording medium; a pressing member pressed against the fixing member for pressing the recording medium against the fixing member; a frame member for supporting the fixing member and the pressing member; a cover member for covering the frame member; and a discharging member for discharging static electricity accumulated on the recording medium. The discharging member is sandwiched and held between the cover member and the frame member.

In fixing device of the present invention, the discharging member is sandwiched and held between the cover member covering the frame member and the frame member supporting the fixing member and the pressing member. Accordingly, it is possible to prevent poor electrical conductivity and securely ground the discharging member. As a result, it is possible to stably discharge the recording medium, thereby securely preventing the recording medium from being transported improperly.

DETAILED DESCRIPTION OF PREFERRED EMBODIMENTS

Hereunder, embodiments of the present invention will be explained with reference to the accompanying drawings. In the embodiments, a printer is explained as an image forming apparatus for forming an image.

First Embodiment

Figure 2:
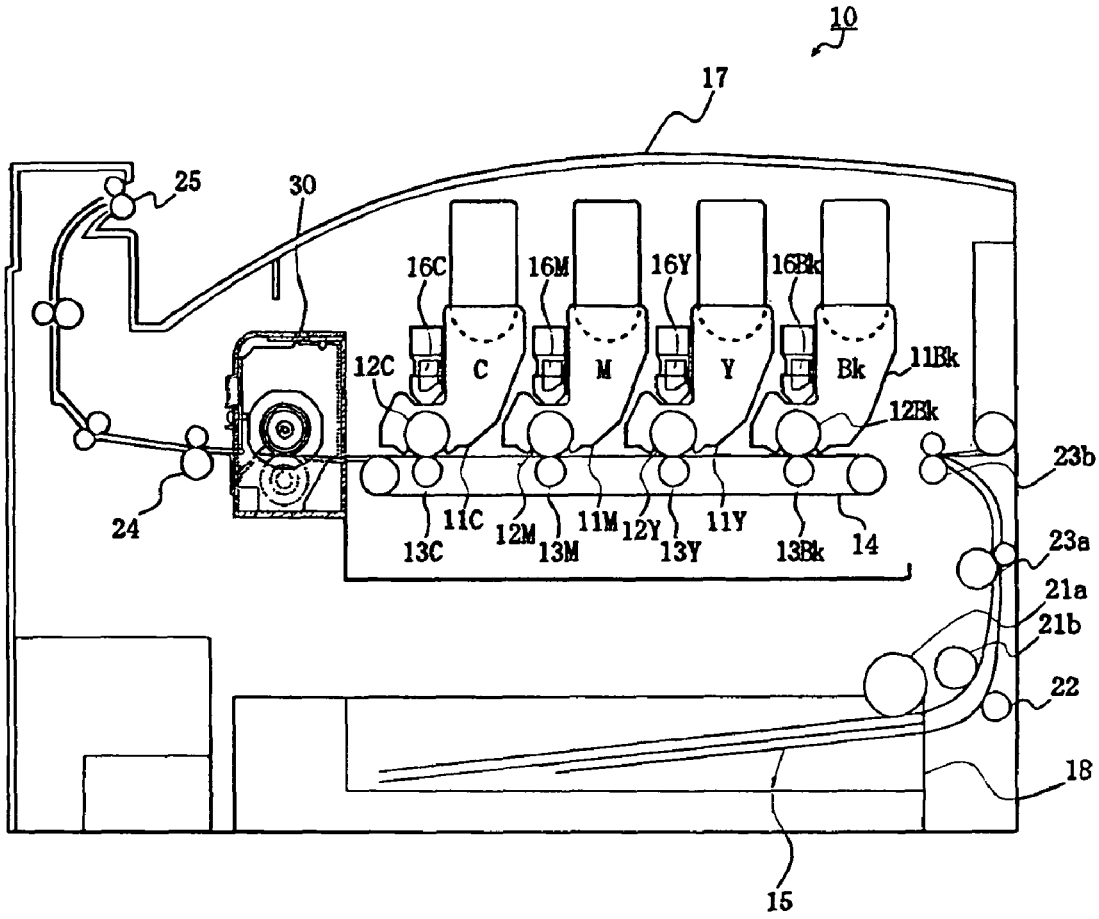
FIG. 2 is a schematic side view showing an image forming apparatus having the fixing device according to the first embodiment of the present invention.

A first embodiment of the present invention will be explained. FIG. 2 is a schematic side view showing an image forming apparatus 10 having a fixing device 30 according to the first embodiment of the present invention.

In the embodiment, the image forming apparatus 10 includes such devices as a printer, a copier, a facsimile, and a Multifunction Peripheral of an electro-photography type for forming an image on a recording medium 15. The image forming apparatus 10 may include any devices as far as the fixing device 30 is disposed therein. Further, the image forming apparatus 10 may form a monochrome image or a color image. In the following description, the image forming apparatus 10 is a printer for forming a color image through a tandem method.

In the embodiment, the recording medium 15 includes an ordinary paper sheet, and may include an OHP (over head projector) sheet, a card, a postcard, a cardboard having a weight of more than about 200 g/m2, an envelop, and a special paper such as a coated paper having a large heat capacity.

As shown in FIG. 2, the image forming apparatus 10 includes image forming units 11Bk, 11Y, 11M, and 11C disposed along a direction that the recording medium 15 is transported for forming toner images in black, yellow, magenta, and cyan. The image forming units 11Bk, 11Y, 11M, and 11C have photosensitive drums 12Bk, 12Y, 12M, and 12C as image supporting members for supporting the toner images in black, yellow, magenta, and cyan on surfaces thereof; a charging device (not shown); a developing device (not shown); and a photosensitive drum cleaning device (not shown).

In the embodiment, the image forming units 11Bk, 11Y, 11M, and 11C are integrated in one unit, so that the unit is detachably attached to the image forming apparatus 10. An upper cover 17 is disposed at an upper portion of the image forming apparatus 10 to freely open and close, so that the image forming units 11Bk, 11Y, 11M, and 11C can be attached or detached.

In the embodiment, exposure devices 16Bk, 16Y, 16M, and 16C formed of LED heads and the likes are disposed to face the photosensitive drums 12Bk, 12Y, 12M, and 12C. The exposure devices 16Bk, 16Y, 16M, and 16C are supported on the upper cover 17. The exposure devices 16Bk, 16Y, 16M, and 16C are provided for exposing the surfaces of the photosensitive drums 12Bk, 12Y, 12M, and 12C to form static latent images thereon.

In the embodiment, transfer rollers 13Bk, 13Y, 13M, and 13C are disposed to face the photosensitive drums 12Bk, 12Y, 12M, and 12C with a transport belt 14 inbetween. The transfer rollers 13Bk, 13Y, 13M, and 13C transfer the toner images in colors formed on the surfaces of the photosensitive drums 12Bk, 12Y, 12M, and 12C to the recording medium 15 transporting on the transport belt 14.

In the embodiment, a sheet supply cassette 18 is disposed at a lower portion of the image forming apparatus 10 for storing the recording medium 15. A sheet supply mechanism is disposed adjacent to a front edge of the sheet supply cassette 18 (right edge in FIG. 2). The sheet supply mechanism includes sheet supply rollers 21*a* and 21*b* and a separation roller 22, so that the recording medium 15 stored in the sheet supply cassette 18 is separated and transported one by one. Transport rollers 23*a* and 23*b* are disposed above the sheet supply mechanism.

In the embodiment, the fixing device 30 is detachably disposed at a downstream side of the transport belt 14. After the recording medium 15 is discharged from the fixing device 30, discharge rollers 24 transport the recording medium 15, and a discharge transport roller 25 discharges the recording medium 15 to be placed on the upper cover 17.

Figure 1:
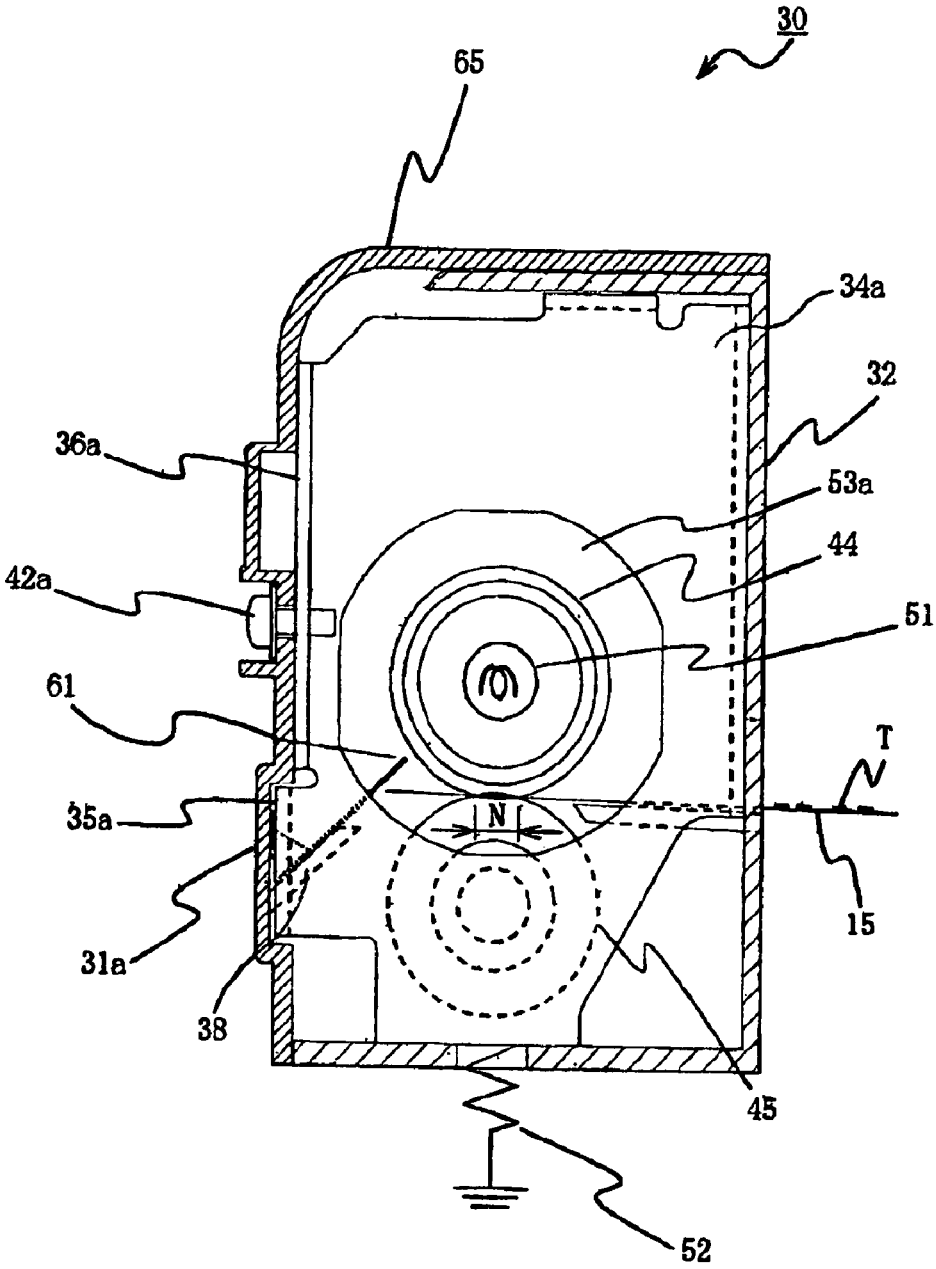
FIG. 1 is a schematic sectional view showing a fixing device taken along a line 1-1 in FIG. 3 according to a first embodiment of the present invention.
Figure 3:
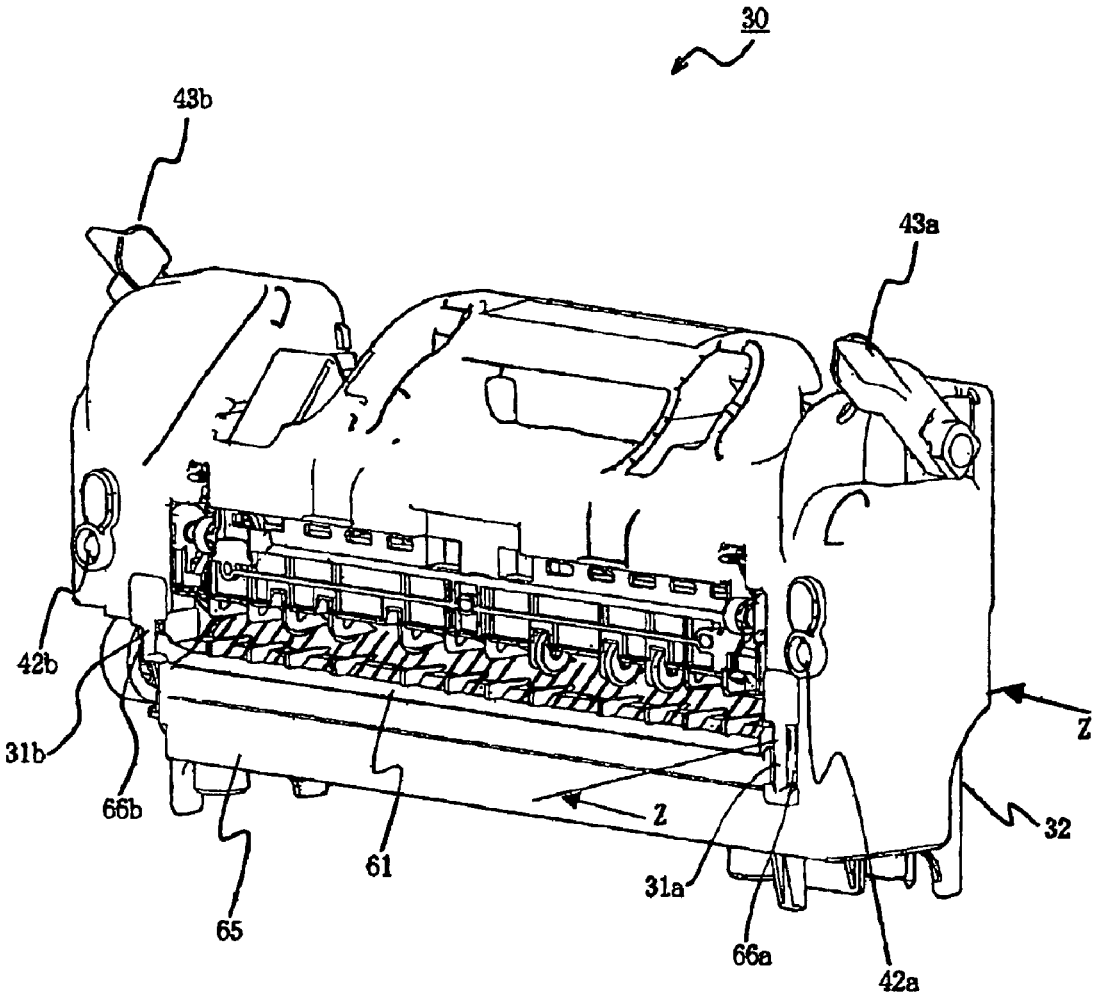
FIG. 3 is a perspective view showing the fixing device viewed in a direction that a recording medium is discharged according to the first embodiment of the present invention.
Figure 4:
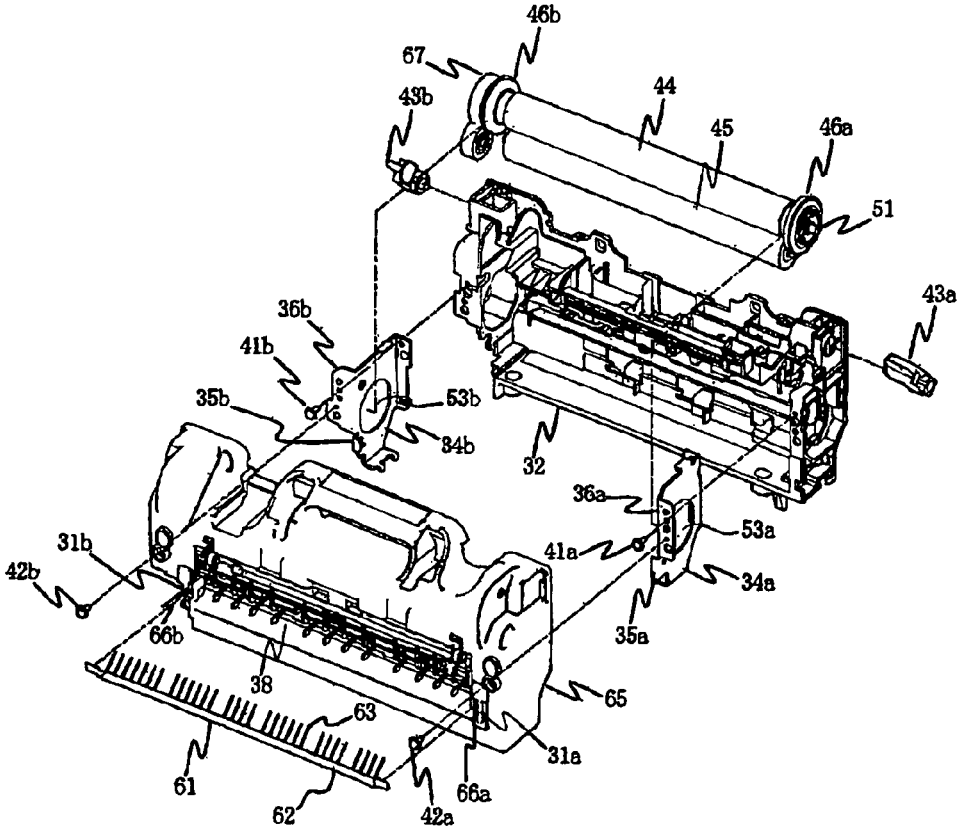
FIG. 4 is an exploded perspective view showing the fixing device viewed in the direction that the recording medium is discharged according to the first embodiment of the present invention.

A configuration of the fixing device 30 will be explained in detail next. FIG. 1 is a schematic sectional view showing the fixing device 30 taken along a line 1-1 in FIG. 3 according to the first embodiment of the present invention. FIG. 3 is a perspective view showing the fixing device 30 viewed in a direction that the recording medium 15 is discharged according to the first embodiment of the present invention. FIG. 4 is an exploded perspective view showing the fixing device 30 viewed in the direction that the recording medium 15 is discharged according to the first embodiment of the present invention.

Figure 5:
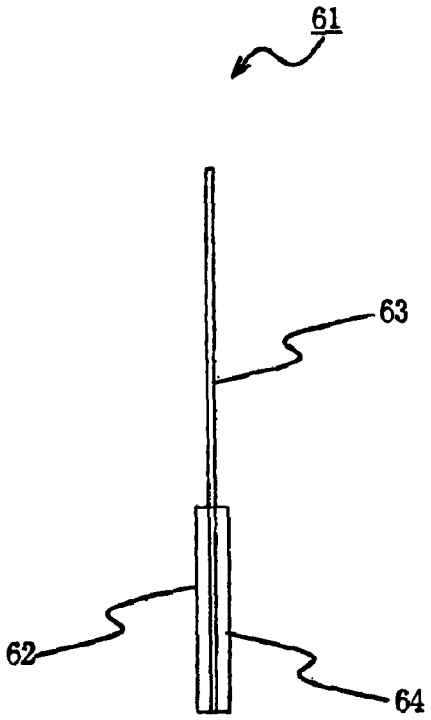
FIG. 5 is a schematic sectional view showing a discharging brush according to the first embodiment of the present invention.
Figure 6:
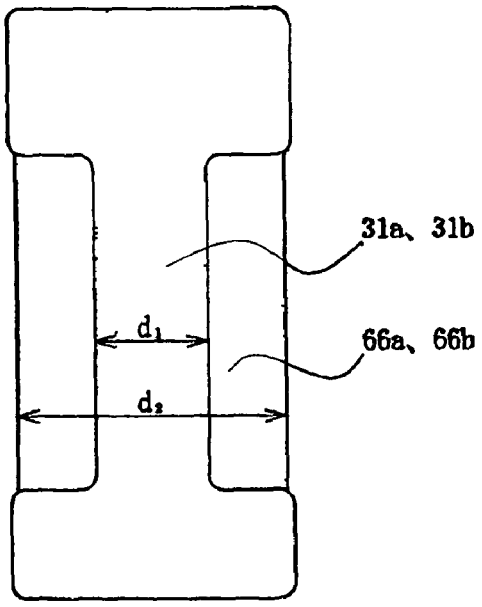
FIG. 6 is an enlarged view showing a supporting member installation opening portion of the discharging brush according to the first embodiment of the present invention.
Figure 7:
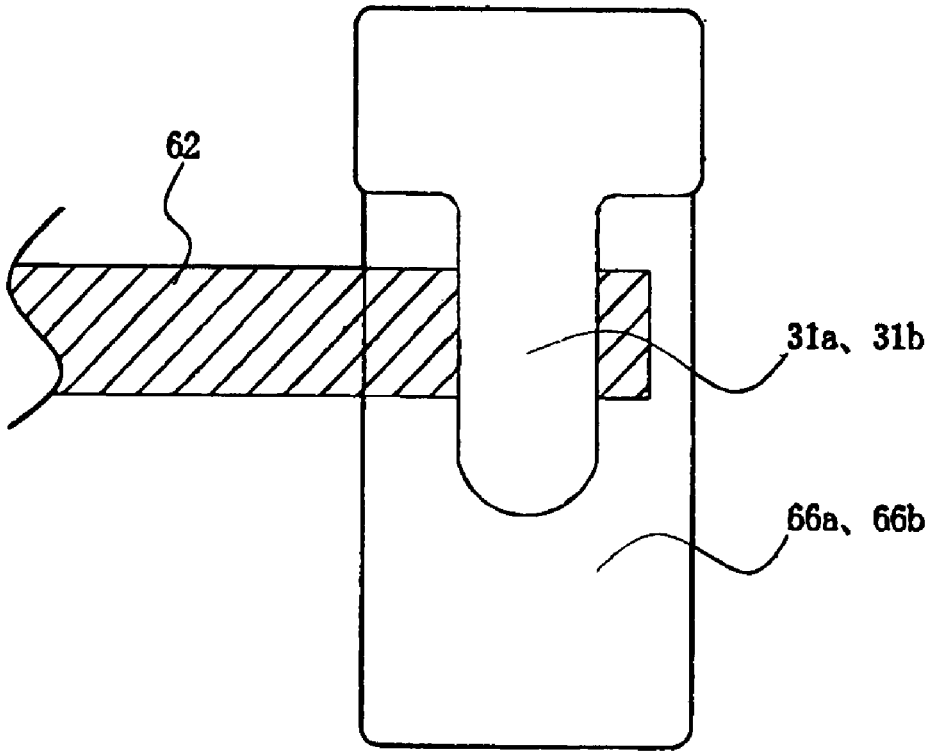
FIG. 7 is an enlarged view showing another example of the supporting member installation opening portion of the discharging brush according to the first embodiment of the present invention.

FIG. 5 is a schematic sectional view showing a discharging brush 61 according to the first embodiment of the present invention. FIG. 6 is an enlarged view showing supporting member installation opening portions 66*a* and 66*b* of the discharging brush 61 according to the first embodiment of the present invention. FIG. 7 is an enlarged view showing another example of the supporting member installation opening portions 66*a* and 66*b* of the discharging brush 61 according to the first embodiment of the present invention.

As shown in FIG. 1, the fixing device 30 includes a fixing roller 44 as a fixing member and a pressing roller 45 as a pressing member. When a pressing device (not shown) presses the pressing roller 45 against the fixing roller 44, a nip portion N is formed between the fixing roller 44 and the pressing roller 45 for fixing a toner image T in an unfixed state to the recording medium 15.

In the embodiment, the fixing roller 44 is formed of a hollow roller having an outer diameter of about 25 mm. In the fixing roller 44, a core metal portion made of aluminum is covered with an elastic layer with high temperature resistance made of a silicone rubber and having a thickness of about 1.2 mm. Further, an outer circumferential surface of the fixing roller 44 is coated with a fluorine resin layer as a release layer having a thickness of 30 μm. The core metal portion may be formed of a metal such as iron other than aluminum.

In the embodiment, the pressing roller 45 is formed of a solid roller having an outer diameter of about 24 mm. In the pressing roller 45, a core metal portion made of iron is covered with an elastic layer with high temperature resistance made of a silicone rubber foam and having a thickness of about 5.0 mm. Further, an outer circumferential surface of the pressing roller 45 is coated with a fluorine resin layer as a release layer having a thickness of 30 μm.

In the embodiment, a thermistor (not shown) is disposed near a surface of the fixing roller 44 as a temperature detection unit. A halogen heater 51 is disposed in the fixing roller 44 as a heating source. The heat source is not limited to the halogen heater 51, and may include an induction-heating member and the likes.

As shown in FIG. 4, side plates 34*a* and 34*b* are disposed on left and right sides of the fixing roller 44 as a frame member. The fixing roller 44 is rotatably supported on the side plates 34*a* and 34*b* through bearings 46*a* and 46*b* disposed on left and right sides. The side plates 34*a* and 34*b* are made of a metal, and include supporting holes 53*a* and 53*b* for supporting the bearings 46*a* and 46*b*; curved portions 36*a* and 36*b* extending toward outside the fixing device 30; and curved portions 35*a* and 35*b* extending toward inside the fixing device 30. Further, the side plates 34*a* and 34*b* have positioning portions for positioning relative to a case member 32, so that the side plates 34*a* and 34*b* are fixed to the case member 32 with screws 41*a* and 41*b*.

In the embodiment, the case member 32 is formed of a heat resistance resin, and retains the fixing roller 44, the pressing roller 45, and other main components of the fixing device 30 therein. As shown in FIGS. 1 and 3, a cover member 65 covers the case member 32 in a state that the case member 32 retains the main components of the fixing device 30. Similar to the case member 32, the cover member 65 is formed of a heat resistance resin.

As shown in FIG. 4, the cover member 65 includes pressing portions 31*a* and 31*b* for pressing left and right edge portions of a thin plate 62, i.e., a brush supporting member provided in the discharging brush 61 or the discharging member; the supporting member installation opening portions 66*a* and 66*b* for guiding the discharging brush 61 to the pressing portions 31*a* and 31*b*; and an attaching member 38 for attaching the discharging brush 61. The pressing portions 31*a* and 31*b* may be integrated with the cover member 65 or be formed in components separated from the cover member 65.

As shown in FIG. 1, the attaching member 38 is disposed below the recording medium 15 discharged from the nip portion N such that the attaching member 38 is aligned with a specific angle relative to the direction that the recording medium 15 is transported. Accordingly, distal ends of linear members 63 of the discharging brush 61 contact with the recording medium 15 at the specific angle. As a result, the linear members 63 of the discharging brush 61 deform elastically and contact with the recording medium 15 for a prolonged period of time, thereby securely discharging the recording medium 15.

In the embodiment, the supporting member installation opening portions 66*a* and 66*b* are situated on both sides of the attaching member 38. As shown in FIG. 6, the pressing portions 31*a* and 31*b* are arranged to straddle the supporting member installation opening portions 66*a* and 66*b*, and are situated at positions facing the curved portions 35*a* and 35*b* formed in the side plates 34*a* and 34*b*. The pressing portions 31*a* and 31*b* have a width d1 smaller than a width d2 of the supporting member installation opening portions 66*a* and 66*b*.

As shown in FIG. 7, the pressing portions 31*a* and 31*b* may have a shape different from that shown in FIG. 6. That is, the pressing portions 31*a* and 31*b* may not necessarily be arranged to straddle the supporting member installation opening portions 66*a* and 66*b*. It is suffice that the pressing portions 31*a* and 31*b* are arranged at positions capable of pressing the thin plate 62.

As shown in FIG. 5, the discharging brush 61 as a discharging member includes the thin plate 62 made of aluminum; the linear members 63 made of aluminum fibers; and a conductive double-sided tape 64, so that the linear members 63 are attached to the thin plate 62 with the conductive double-sided tape 64. Further, as shown in FIG. 4, the thin plate 62 is attached to the attaching member 38 of the cover member 65 with the conductive double-sided tape 64.

In the embodiment, the thin plate 62 has both edge portions curved into inside through the supporting member installation opening portions 66*a* and 66*b* of the cover member 65. As shown in FIGS. 1, 3, and 4, the cover member 65 is fixed to the curved portions 36*a* and 36*b* formed in the side plates 34*a* and 34*b* with screws 42*a* and 42*b*. Accordingly, the both edge portions of the thin plate 62 are sandwiched and held between the curved portions 35*a* and 35*b* formed in the side plates 34*a* and 34*b* and the pressing portions 31*a* and 31*b* of the cover member 65.

As shown in FIG. 4, the both edge portions of the thin plate 62 represent areas without the linear members 63 and have a specific length toward inside from ends of the thin plate 62. It is suffice that the both edge portions of the thin plate 62 have a sufficient length to be sandwiched between the curved portions 35*a* and 35*b* and the pressing portions 31*a* and 31*b*.

In the embodiment, the fixing device 30 is fixed at a specific position in the image forming apparatus 10 with lock levers 43*a* and 43*b*. At this time, the side plates 34*a* and 34*b* of the fixing device 30 elastically contact with a conductive spring 52 disposed in the image forming apparatus 10. Further, the conductive spring 52 is electrically connected to a metal frame (not shown) disposed in the image forming apparatus 10 as a grounding member. Accordingly, the discharging brush 61 is electrically connected and grounded to the metal frame of the image forming apparatus 10 or the grounding member through the side plates 34*a* and 34*b*, the conductive spring 52, and the likes.

An operation of the image forming apparatus 10 will be explained next. After the recording medium 15 is stored in the sheet supply cassette 18, the sheet supply rollers 21*a* and 21*b* and the separation roller 22 separate and transport the recording medium 15 one by one. Then, the transport rollers 23*a* and 23*b* transport the recording medium 15 to the transport belt 14. The charge device (not shown) charges the surfaces of the photosensitive drums 12Bk, 12Y, 12M, and 12C, and the exposure devices 16Bk, 16Y, 16M, and 16C expose the surfaces of the photosensitive drums 12Bk, 12Y, 12M, and 12C to form the static latent images thereon. The developing device develops the static latent images to form the toner images or developer images in black, yellow, magenta, and cyan on the surfaces of the photosensitive drums 12Bk, 12Y, 12M, and 12C.

Afterward, as the transport belt 14 moves, the recording medium 15 passes through between the photosensitive drums 12Bk, 12Y, 12M, and 12C and the transfer rollers 13Bk, 13Y, 13M, and 13C, so that the toner images in black, yellow, magenta, and cyan are sequentially transferred to the recording medium 15, thereby forming the toner image in colors on the recording medium 15. The photosensitive drum cleaning device (not shown) removes toner remaining on the photosensitive drums 12Bk, 12Y, 12M, and 12C.

After transferring the toner images, the recording medium 15 is transported to the fixing device 30. The fixing device 30 fixes the toner image T in an unfixed state to the recording medium 15, thereby forming an image in colors. After the toner image is fixed to the recording medium 15, the discharge rollers 24 transport the recording medium 15, and the discharge transport roller 25 discharges the recording medium 15 to be placed on the upper cover 17, thereby stacking the recording medium 15.

An operation of the fixing device 30 will be explained next. When the image forming apparatus 10 starts the printing operation, the fixing roller 44 of the fixing device 30 starts rotating. A fixing device drive gear disposed in a main body of the image forming apparatus 10 drives a fixing roller gear 67 attached to an end portion of the fixing roller 44 to rotate in the direction that the recording medium 15 is transported. The pressing roller 45 rotates accompany with the fixing roller 44.

A power supply circuit (not shown) supplies a current to the halogen heater 51, so that the halogen heater 51 heats the fixing roller 44 from inside thereof. The thermistor (not shown) detects a surface temperature of the fixing roller 44, and the surface temperature is input to a temperature control circuit of a control unit (not shown).

According to the surface temperature of the fixing roller 44 thus detected, the temperature control circuit controls the current supplied from the power supply circuit to the halogen heater 51, so that the surface temperature of the fixing roller 44 is maintained at a fixing temperature. While the surface temperature of the fixing roller 44 is maintained at the fixing temperature, the recording medium 15 is sandwiched at the nip portion N. Accordingly, the fixing roller 44 heats the toner image T in an unfixed state, and the pressing roller 45 presses the recording medium 15 with specific pressure, so that the toner image T is fixed to the recording medium 15.

In the embodiment, the outer circumferential surfaces of the fixing roller 44 and the pressing roller 45 are coated with a fluorine resin layer as the release layer. Accordingly, when the recording medium 15 passes through the nip portion N, the recording medium 15 tends to be charged through friction and the likes.

As described above, the fixing device 30 is provided with the discharging brush 61. Further, the linear members 63 of the discharging brush 61 are situated below the recording medium 15 discharged from the nip portion N, such that the linear members 63 are oriented at the specific angle with respect to the direction that the recording medium 15 is transported. Accordingly, when the toner image is fixed to the recording medium 15, and the recording medium 15 passes through the nip portion N, the recording medium 15 is discharged while contacting the distal ends of the linear members 63 of the discharging brush 61. The discharging brush 61 is grounded through the side plates 34*a* and 34*b*, the conductive spring 52, and the likes. Accordingly, electron charges on the recording medium 15 are removed through the contact between the distal ends of the linear members 63 and the recording medium 15.

As described above, in the embodiment, the both edge portions of the thin plate 62 in the discharging brush 61 are attached to the side plates 34*a* and 34*b* as the frame member, and are pressed and held with the cover member 65. Accordingly, when the side plates 34*a* and 34*b* become hot during the fixing process, it is possible to prevent the discharging brush 61 from coming off the side plates 34*a* and 34*b* thus grounded, thereby preventing poor electrical conduction. As a result, it is possible to stably discharge the recording medium 15, thereby preventing a transportation trouble such as improper stacking.

Second Embodiment

A second embodiment of the invention will be described below. Components in the second embodiment similar to those in the first embodiment are designated by the same reference numerals, and explanations thereof are omitted. The components in the second embodiment similar to those in the first embodiment provide effects similar to those in the first embodiment, and explanations thereof are omitted.

Figure 8:
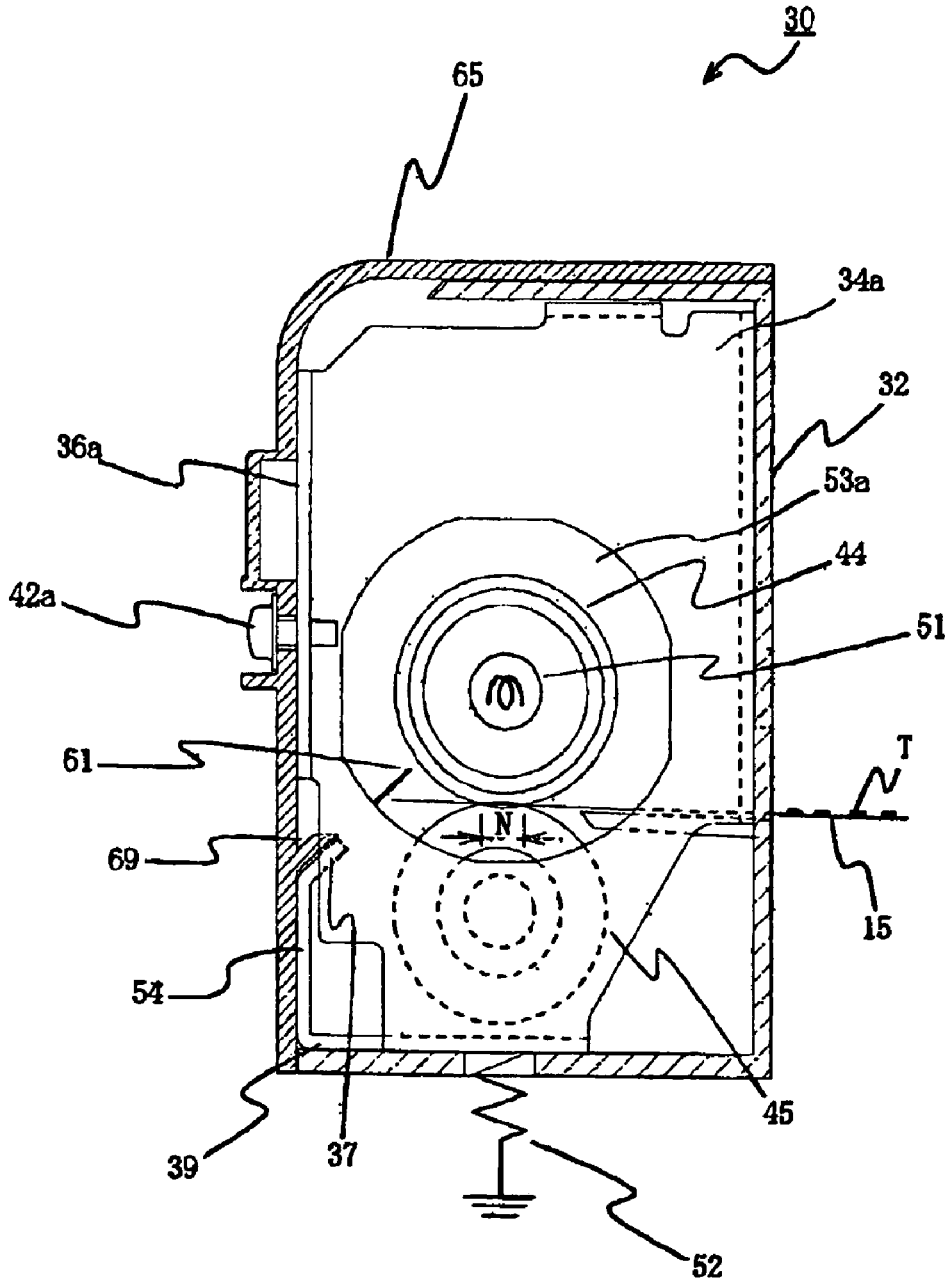
FIG. 8 is a schematic sectional view showing a fixing device taken along a line 8-8 in FIG. 9 according to a second embodiment of the present invention.
Figure 9:
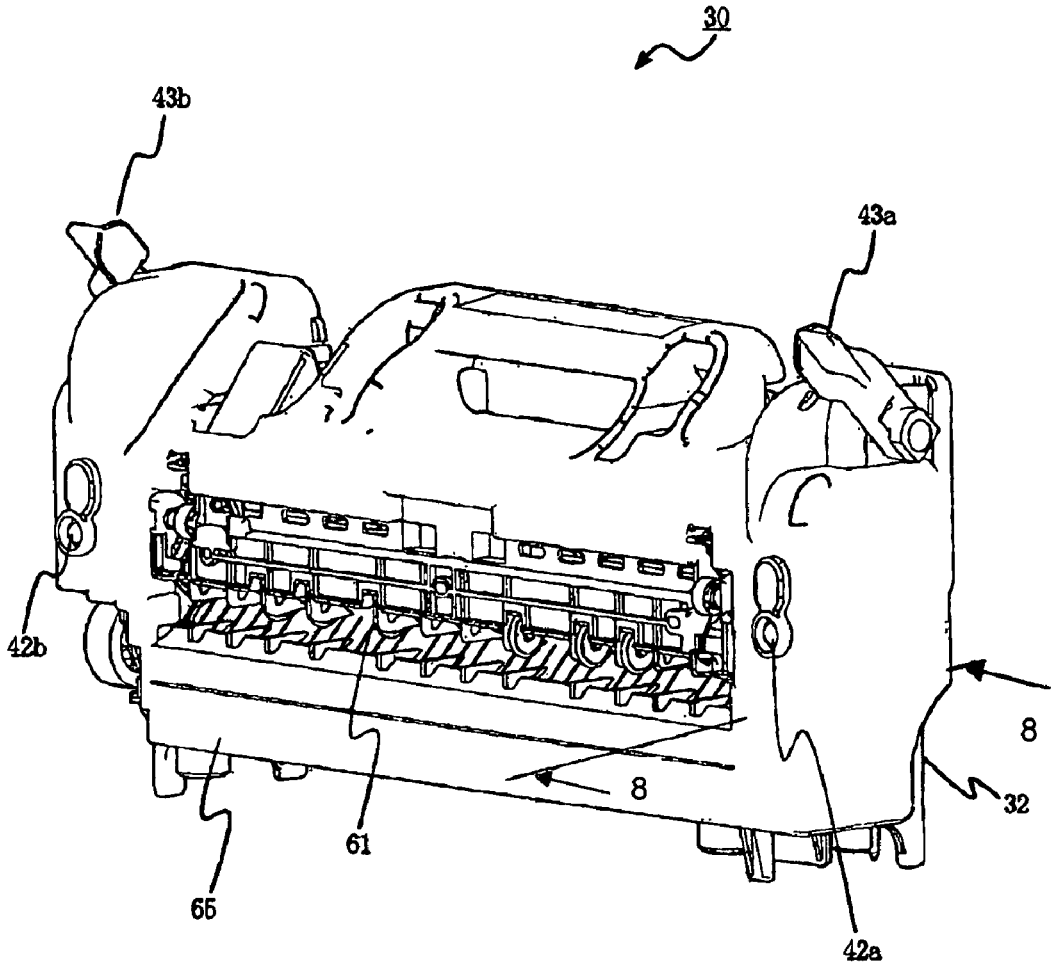
FIG. 9 is a perspective view showing the fixing device viewed in a direction that a recording medium is discharged according to the second embodiment of the present invention.
Figure 10:
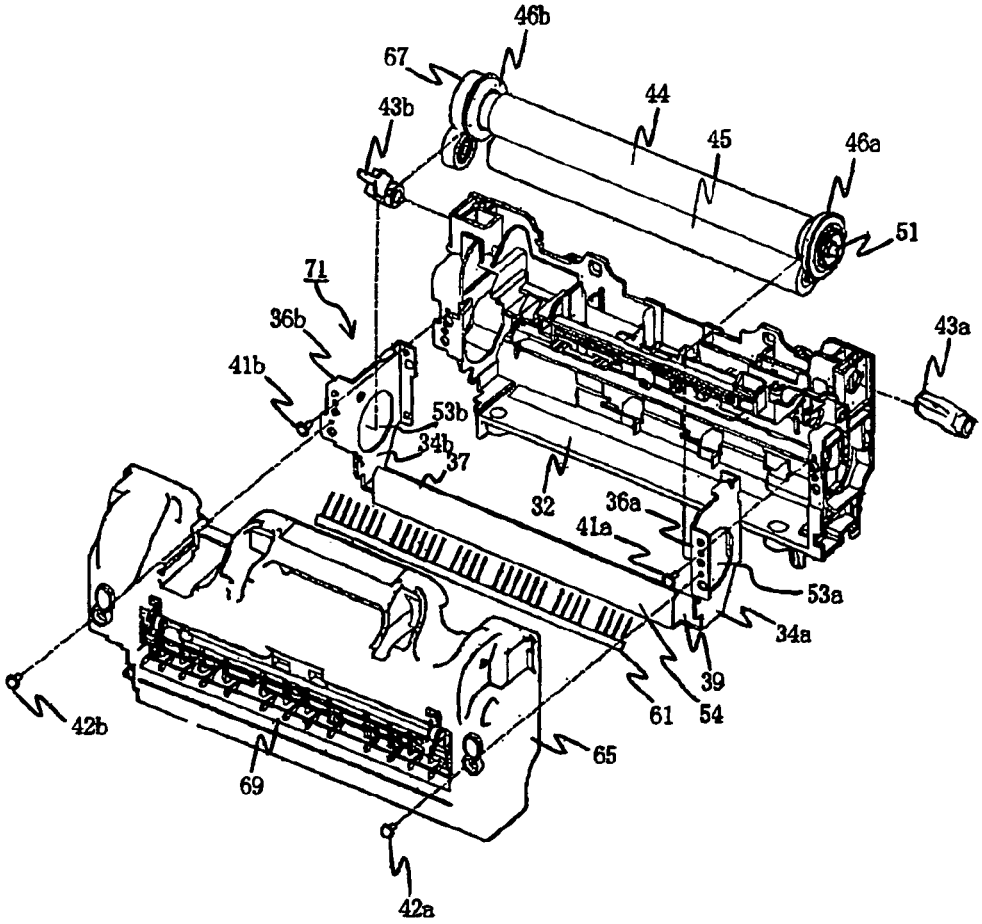
FIG. 10 is an exploded perspective view showing the fixing device viewed in the direction that the recording medium is discharged according to the second embodiment of the present invention.
Figure 11:
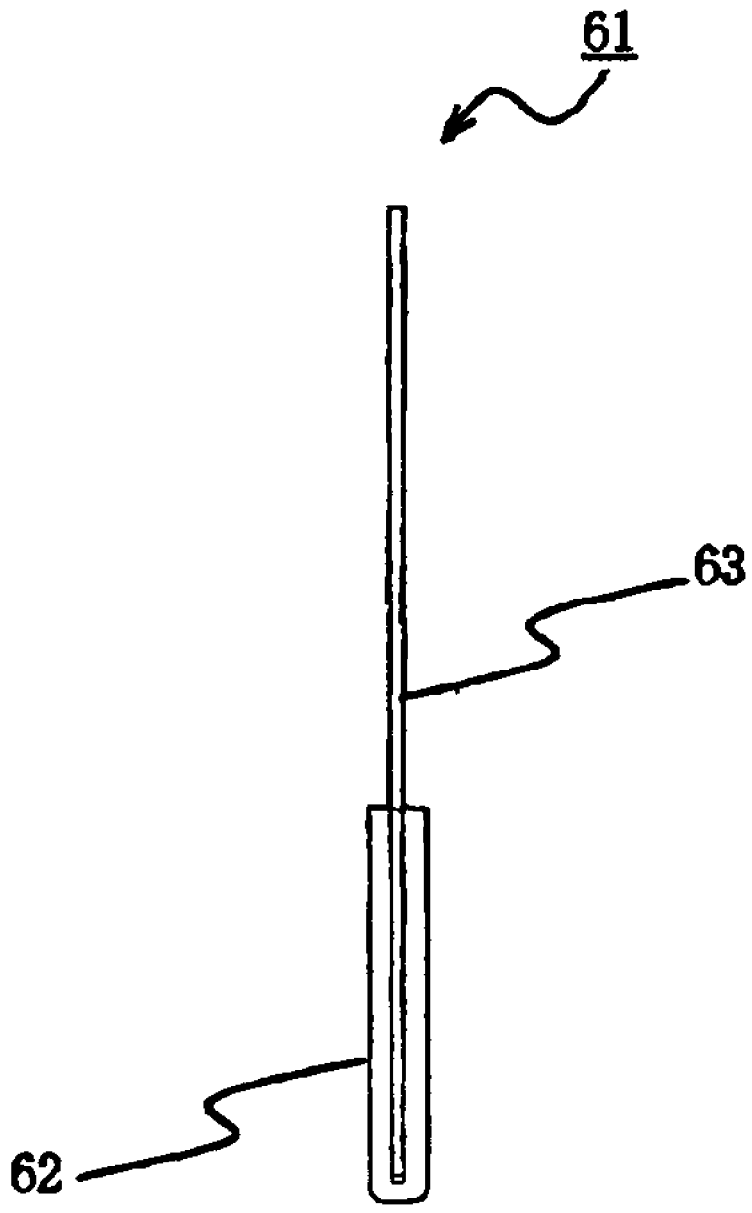
FIG. 11 is a schematic sectional view showing a discharging brush according to the second embodiment of the present invention.

FIG. 8 is a schematic sectional view showing the fixing device 30 taken along a line 8-8 in FIG. 9 according to the second embodiment of the present invention. FIG. 9 is a perspective view showing the fixing device 30 viewed in a direction that the recording medium 15 is discharged according to the second embodiment of the present invention. FIG. 10 is an exploded perspective view showing the fixing device 30 viewed in the direction that the recording medium 15 is discharged according to the second embodiment of the present invention. FIG. 11 is a schematic sectional view showing the discharging brush 61 according to the second embodiment of the present invention.

As shown in FIGS. 8 and 10, in the embodiment, the fixing roller 44 and the pressing roller 45 are attached to a frame member 71. The frame member 71 includes the side plates 34*a* and 34*b* and a curved bottom portion 39 connected between the side plates 34*a* and 34*b*. A wall portion 54 extending upward perpendicularly is connected to an edge portion of the curved bottom portion 39. A curved portion 37 is formed on an upper edge of the wall portion 54 with a specific angle relative to the wall portion 54. The frame member 71 is formed of a metal.

In the embodiment, the cover member 65 is provided with a pressing portion 69 disposed at a position facing the curved portion 37 of the frame member 71 for pressing the discharging brush 61. The thin plate 62 or a brush supporting member of the discharging brush 61 is sandwiched and held between the curved portion 37 and the pressing portion 69.

As shown in FIG. 8, the curved portion 37 and the pressing portion 69 are disposed below the recording medium 15 discharged from the nip portion N with a specific angle relative to the direction that the recording medium 15 is discharged. Accordingly, the distal ends of the linear members 63 of the discharging brush 61 contact with the recording medium 15 at the specific angle. As a result, the linear members 63 of the discharging brush 61 deform elastically and contact with the recording medium 15 for a prolonged period of time, thereby securely discharging the recording medium 15.

As shown in FIG. 11, the discharging brush 61 includes the thin plate 62 made of aluminum and the linear members 63 made of aluminum fibers. The linear members 63 are fixed and held with the thin plate 62. Further, the linear members 63 are attached to the thin plate 62 with an adhesive (not shown) such as a thermo-setting adhesive and a double-sided tape.

As shown in FIGS. 8 to 10, similar to the first embodiment, the cover member 65 is fixed to the curved portions 36*a* and 36*b* formed in the side plates 34*a* and 34*b* of the frame member 71 with the screws 42*a* and 42*b*. Accordingly, the thin plate 62 is sandwiched and held between the curved portion 37 of the frame member 71 and the pressing portion 69 of the cover member 65.

As described above, in the embodiment, the thin plate 62, i.e., a supporting member of the discharging brush 61, is sandwiched and held between the curved portion 37 of the frame member 71 and the pressing portion 69 of the cover member 65. Accordingly, it is not necessary to use a double-sided tape. As a result, when the fixing device 30 becomes hot, it is possible to securely conduct the discharging brush 61. Other components and operations in the second embodiment are similar to those in the first embodiment, and explanations thereof are omitted.

As described above, the thin plate 62 is held with the frame member 71 and the cover member 65 without using a double-sided tape. As a result, when the frame member 71 becomes hot during the fixing operation, it is possible to prevent poor conduction. Accordingly, it is possible to stably discharge the recording medium 15 further than that in the first embodiment, thereby securely preventing improper transportation such as improper stacking.

Third Embodiment

A third embodiment of the present invention will be explained next. In a conventional fixing device, when a discharging brush has a large length, a linear member tends to deform or fall (hereunder, referred to also as bend) as the number of printed sheets increases. In contrast, when a discharging brush has a small length, a distal end of a linear member may not contact with a recording medium. In either case, it is difficult to stably contact the discharging brush with the recording medium, thereby not obtaining sufficient discharge effect.

In the third embodiment, an object is to provide a fixing device and an image forming apparatus with the fixing device capable of solving the problems of the conventional fixing device described above. In the fixing device in the third embodiment, it is possible to stably contact a linear member with a recording medium, thereby obtaining sufficient discharge effect. Components in the third embodiment similar to those in the first embodiment are designated with the same reference numerals, and explanations thereof are omitted. Further omitted are explanations of an operation and an effect in the third embodiment similar to those in the first embodiment.

Figure 12:
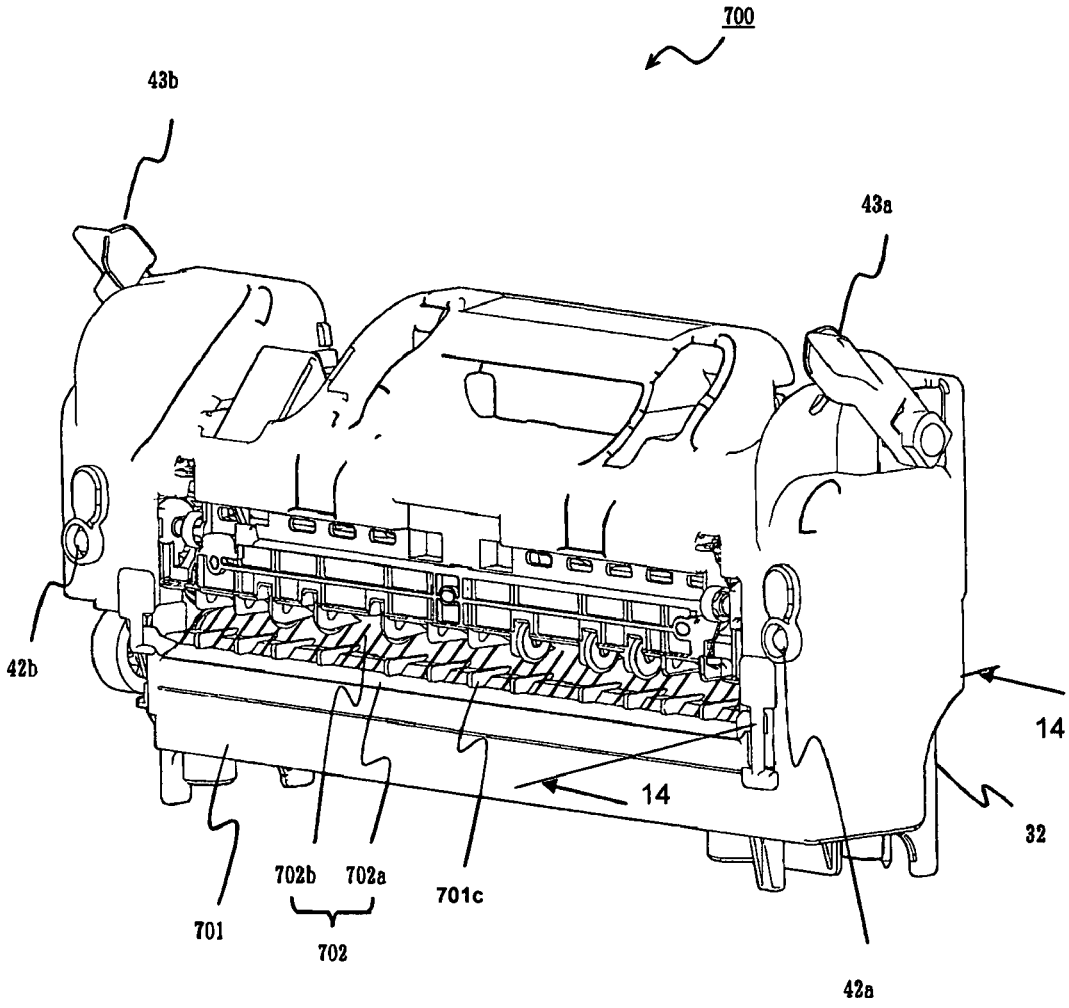
FIG. 12 is a perspective view showing a fixing device according to a third embodiment of the present invention.
Figure 13:
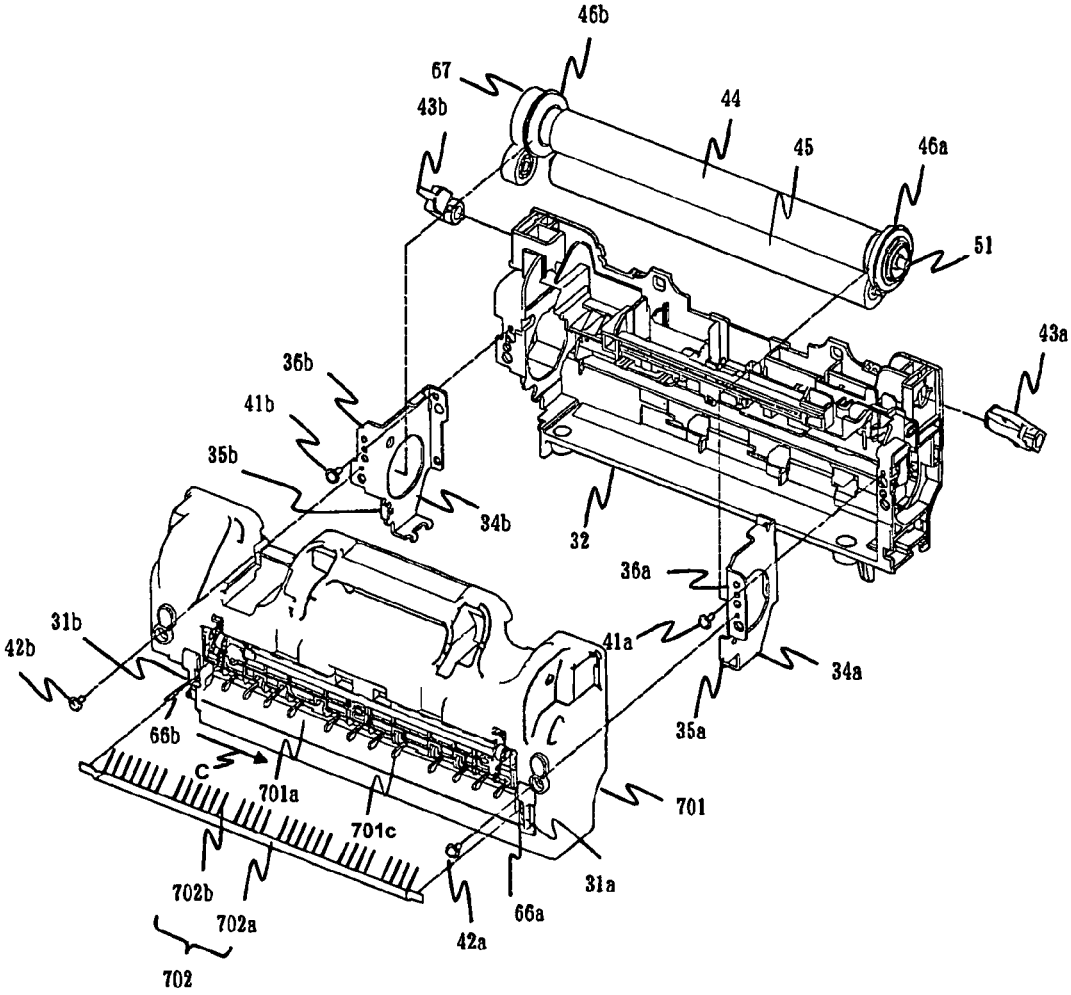
FIG. 13 is an exploded perspective view showing the fixing device according to the third embodiment of the present invention.
Figure 14:
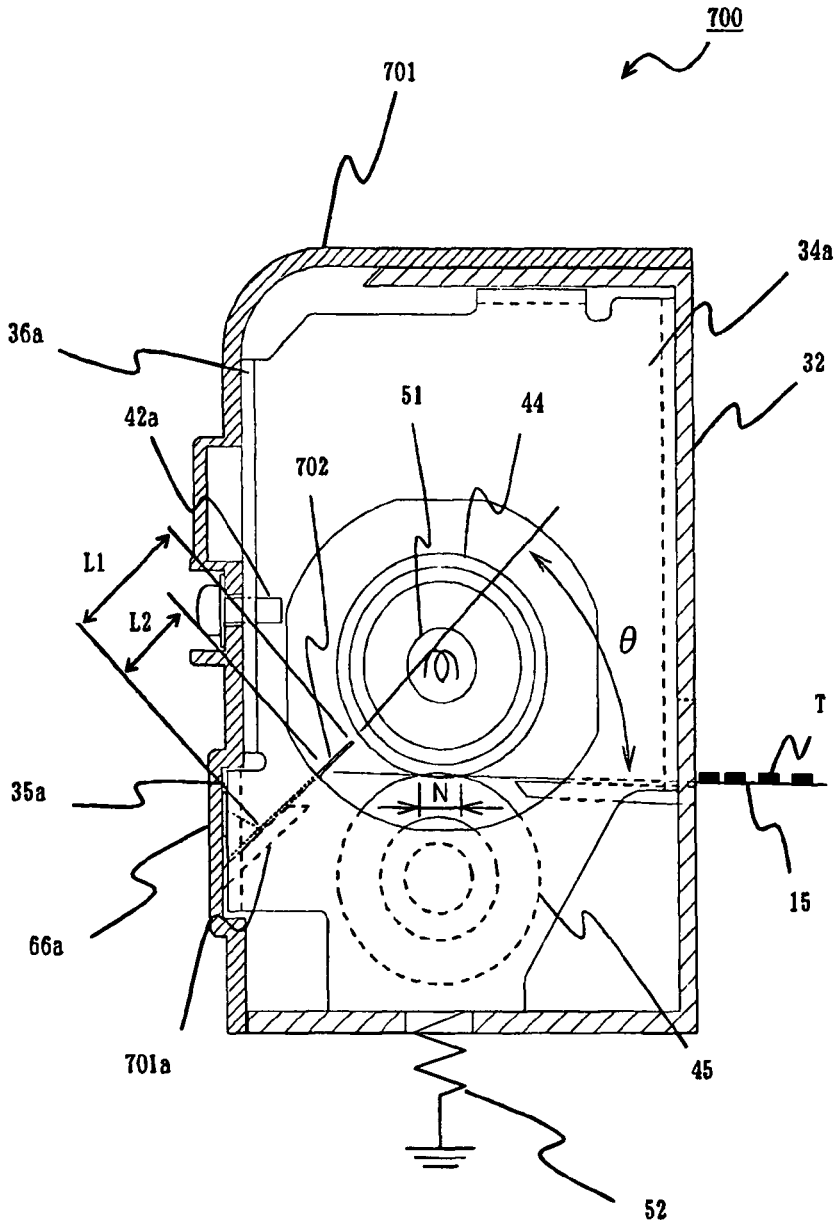
FIG. 14 is a schematic sectional view showing the fixing device taken along a line 14-14 in FIG. 12 according to the third embodiment of the present invention.
Figure 15:
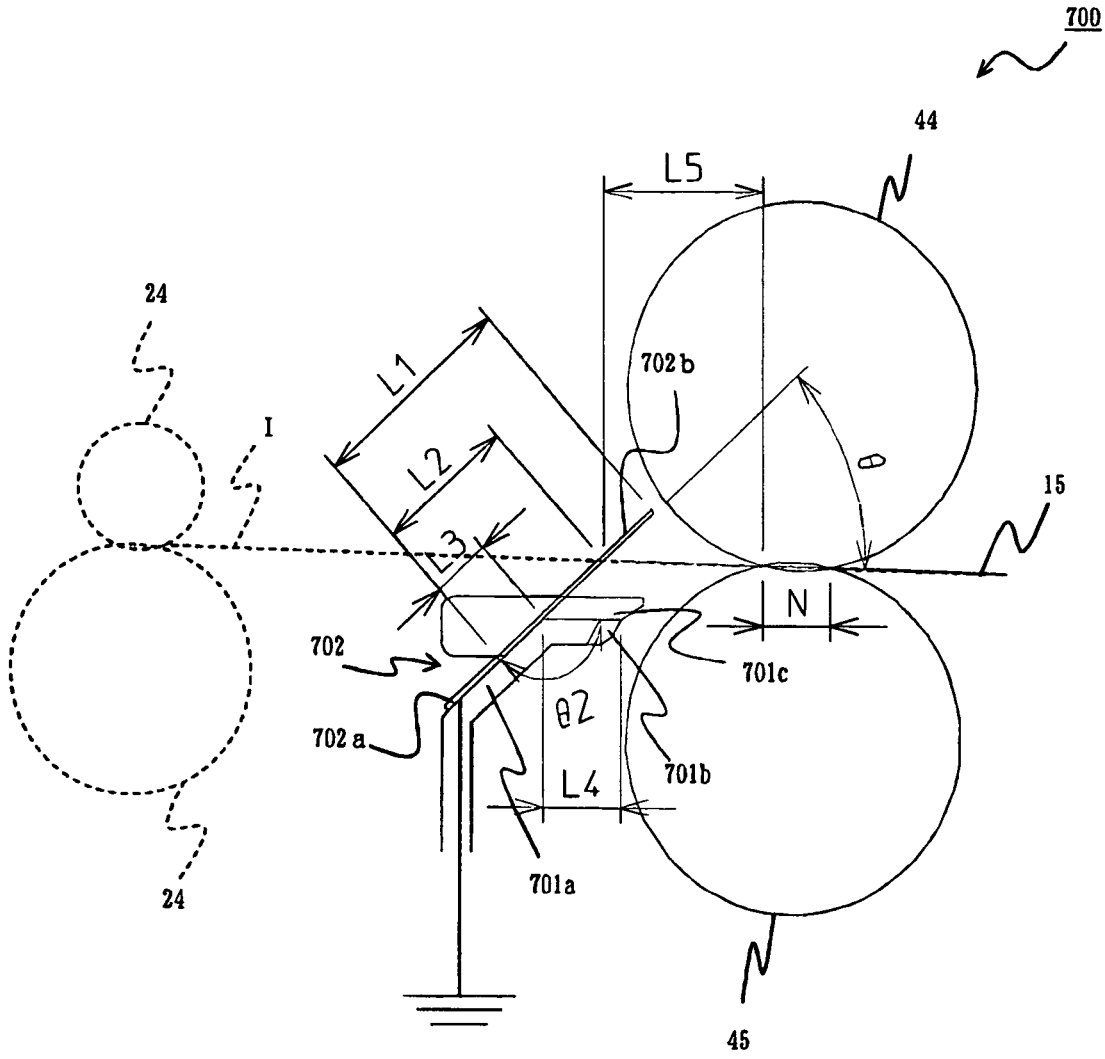
FIG. 15 is a schematic sectional view showing the fixing device according to the third embodiment of the present invention.

FIG. 12 is a perspective view showing a fixing device 700 according to the third embodiment of the present invention. FIG. 13 is an exploded perspective view showing the fixing device 700 according to the third embodiment of the present invention. FIG. 14 is a schematic sectional view showing the fixing device 700 taken along a line 14-14 in FIG. 12 according to the third embodiment of the present invention. FIG. 15 is a schematic sectional view showing the fixing device 700 according to the third embodiment of the present invention.

As shown in FIGS. 12 and 13, the fixing device 700 is provided with a cover member 701. Further, the cover member 701 includes the pressing portions 31*a* and 31*b* for pressing left and right edge portions of a thin plate 702*a* of a discharging brush 702, i.e., a brush supporting member; the supporting member installation opening portions 66*a* and 66*b* for guiding the discharging brush 702 to the pressing portions 31*a* and 31*b*; and an attaching member 701*a* or an inclined member for attaching the discharging brush 702 in an inclined state. A horizontal member 701*b* extending horizontally toward the pressing roller 45 is formed at an upper edge of the attaching member 701*a*. The cover member 701 is formed of a heat resistance resin.

As shown in FIG. 15, the fixing roller 44 is pressed against the pressing roller 45 at the nip portion N, and the discharge rollers 24 are pressed against each other at another nip portion. A plane area between the nip portion N and the nip portion of the discharge rollers 24 is referred to as an ideal medium transport plane I. In an ideal situation, the ideal medium transport plane I is such a plane that the recording medium 15 is transported linearly without warping or receiving resistance from the discharging brush 702. In an actual situation, the recording medium 15 is transported in a specific space including the ideal medium transport plane I.

In the embodiment, the attaching member 701*a* is disposed below the ideal medium transport plane I in an upward inclined state with respect to the fixing roller 44. As shown in FIG. 15, an inclination angel θ of the attaching member 701*a* with respect to the ideal medium transport plane I is defined as an angle between the attaching member 701*a* and the ideal medium transport plane I.

The attaching member 701*a* is formed of a heat-resistance resin integrated with the cover member 701, and may be formed in a component separated from the cover member 701. When the attaching member 701*a* is formed in a component separated from the cover member 701, it is preferred that the attaching member 701*a* is formed of a material having a thermal expansion coefficient similar to that of the cover member 701.

As shown in FIGS. 12, 13 and 15, the attaching member 701*a* and the horizontal member 701*b* are integrally provided with a plurality of guide rib members 701*c* with a specific interval therebetween in a direction C crossing the direction that the recording medium 15 is transported. As shown in FIG. 15, each of the guide rib members 701*c* is situated below the ideal medium transport plane I, and extends toward the pressing roller 45.

In the embodiment, twelve of the guide rib members 701*c* are disposed with the specific interval therebetween along the direction C. Each of the guide rib members 701*c* has a distal end away from the pressing roller 45 by a distance of 25 mm. With the configuration, the guide rib members 701*c* stably guide the recording medium 15 while preventing the recording medium 15 from rolling up on the pressing roller 45. Each of the guide rib members 701*c* may be formed in a component separated from the cover member 701. In this case, it is preferred that the guide rib members 701*c* are formed of a material having a thermal expansion coefficient similar to that of the cover member 701. When the guide rib members 701*c* are formed of a material different from that of the cover member 701, the guide rib members 701*c* are preferably formed of a fluorine resin having good toner separation.

In the embodiment, the guide rib members 701*c* are arranged with the specific interval therebetween, so that an edge of the recording medium 15 having a standard size such as A4, B5, A6, and a postcard is not caught with the guide rib members 701*c* during transportation. As shown in FIGS. 12 and 13, the guide rib members 701*c* are arranged such that four of the guide rib members 701*c* are arranged with the specific interval in three groups, and the three groups are arranged with an interval larger than the specific interval. With the arrangement, it is possible to prevent the recording medium 15 from jamming upon being discharged. The arrangement is just an example, and may be adjusted according to a configuration of the fixing device 700, as far as it is possible to prevent the recording medium 15 from jamming upon being discharged.

Figure 16:
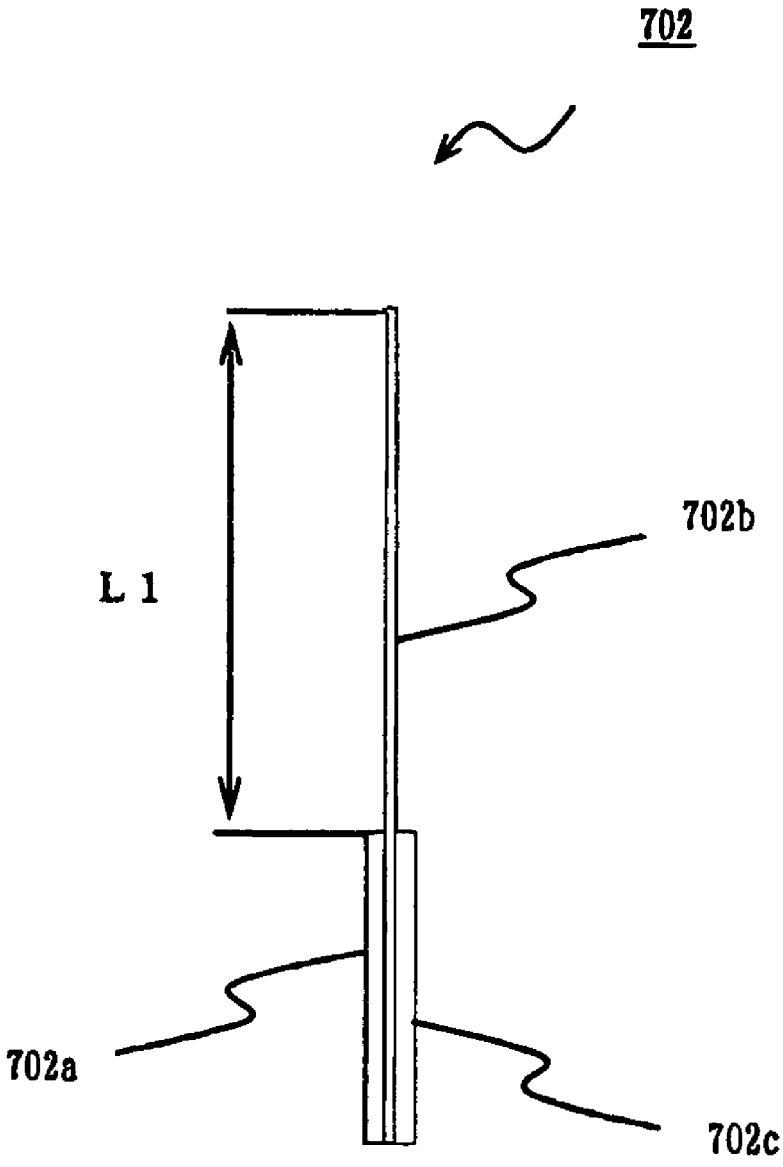
FIG. 16 is a schematic sectional view showing a discharging brush according to the third embodiment of the present invention.
Figure 17:
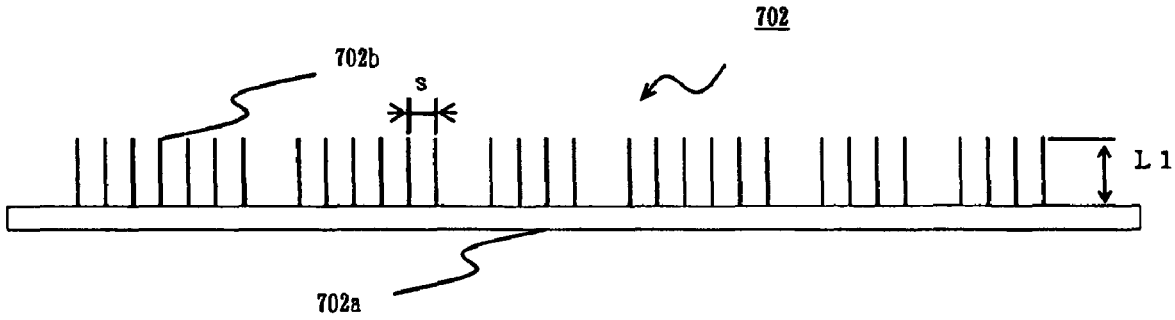
FIG. 17 is a schematic front view of the discharging brush according to the third embodiment of the present invention.

A configuration of the discharge brush 702 will be explained in detail next. FIG. 16 is a schematic sectional view showing the discharging brush 702 according to the third embodiment of the present invention. FIG. 17 is a schematic front view of the discharging brush 702 according to the third embodiment of the present invention.

As shown in FIG. 16, the discharging brush 702 as a discharging member includes a thin plate 702*a* made of aluminum as a discharging brush supporting member; linear members 702*b* made of aluminum fibers; and a conductive double-sided tape 702*c*. The linear members 702*b* are exposed from the thin plate 702*a* by a length L1. A specific area of a base portion of the linear members 702*b* is attached to the thin plate 702*a* with one side of the conductive double-sided tape 702*c*. The discharging brush 702 is attached to the attaching member 701*a* with the other side of the conductive double-sided tape 702*c*.

As shown in FIG. 17, the linear members 702*b* are arranged with a specific pitch interval "s" viewed from a downstream side in the direction that the recording medium 15 is transported. Further, the linear members 702*b* are arranged with spaces having a length larger than the pitch interval "s", so that the guide rib members 701*c* are disposed in the spaces. Accordingly, when the discharging brush 702 is attached to the attaching member 701*a*, it is possible to prevent the linear members 702*b* from interfering with the guide rib members 701*c*. The arrangement is just an example, and the linear members 702*b* may be arranged with various numbers or pitch intervals as far as the effect of the present invention can be obtained.

In the embodiment, each of the linear members 702*b* of the discharging brush 702 is formed of about eighty of fine metal wires having a diameter of about 12 μm and bundled in a single linear member. Thirty-one of the linear members 702*b* are arranged with the pitch interval "s" of 6.4 mm in a width of 224 mm along the direction crossing the ideal medium transport plane I. Instead of the fine metal wires, the linear members 702*b* may be formed of conductive heat-resistance resin fibers (for example, acrylic resin fibers, nylon resin fibers, and the likes) containing such additives as copper ions, carbon black, carbon fibers, and the likes.

As shown in FIGS. 13 and 14, the base portion of the discharging brush 702 is attached to the attaching member 701*a* with the conductive double-sided tape 702*c*. Accordingly, the linear members 702*b* of the discharging brush 702 extend toward the fixing roller 44 along the inclination angel θ of the attaching member 701*a*, so that the linear members 702*b* are inclined with respect to the ideal medium transport plane I by an angle substantially same as the inclination angel θ of the attaching member 701*a*.

As shown in FIG. 12, the thin plate 702*a* of the discharging brush 702 is fixed to the attaching member 701*a* at a position below the guide rib members 701*c*. With the arrangement, it is possible to attach a base portion of the discharging brush 702 to the attaching member 701*a* without interfering with the guide rib members 701*c*.

Similar to the first embodiment, the thin plate 702*a* has both edge portions curved into inside through the supporting member installation opening portions 66*a* and 66*b* of the cover member 701. Accordingly, the both edge portions of the thin plate 702*a* are sandwiched and held between the curved portions 35*a* and 35*b* formed in the side plates 34*a* and 34*b* and the pressing portions 31*a* and 31*b* of the cover member 701.

As shown in FIG. 13, the both edge portions of the thin plate 702*a* represent areas without the linear members 702*b* and have a specific length toward inside from ends of the thin plate 702*a*. It is suffice that the both edge portions of the thin plate 702*a* have a sufficient length to be sandwiched between the curved portions 35*a* and 35*b* and the pressing portions 31*a* and 31*b*.

In the embodiment, the fixing device 700 is fixed at a specific position in the image forming apparatus (not shown) with lock levers 43*a* and 43*b*. At this time, the side plates 34*a* and 34*b* elastically contact with a conductive spring disposed in the image forming apparatus. Further, the conductive spring is electrically connected to a metal frame of the image forming apparatus. Accordingly, the discharging brush 702 is electrically connected and grounded to the metal frame of the image forming apparatus 10 as a grounding member through the side plates 34*a* and 34*b*, the conductive spring, and the likes.

As shown in FIG. 15, it is arranged such that the linear members 702*b* are exposed from the thin plate 702*a* by a length L3 of 4.0 mm facing the attaching member 701*a*; the horizontal member 701*b* extending horizontally from the attaching member 701*a* toward the pressing roller 45 has a length L4 of 6.0 mm; a distance L5 between the nip portion N and the linear members 702*b* is 12.0 mm; and an angle 62 between the attaching member 701*a* and the horizontal member 701*b* becomes 135°.

An operation of the fixing device 700 will be explained next. After the toner image T is transferred, when the recording medium 15 with the toner image T passes through the nip portion N of the fixing roller 44 and the pressing roller 45, the toner image T is fixed to the recording medium 15. At this moment, electrical charges are accumulated on the recording medium 15 due to transport friction receiving from the fixing roller 44 and the pressing roller 45 when the recording medium 15 passes through the nip portion N.

Afterward, the recording medium 15 is discharged from the fixing device 700 and passes through a specific space including the ideal medium transport plane I, while contacting with the distal ends of the discharging brush 702. As described above, the discharging brush 702 is grounded through the side plates 34*a* and 34*b* and the elastic spring 52. Accordingly, when the recording medium 15 contacts with the discharging brush 702, the electrical charges accumulated on the recording medium 15 due to the fixing roller 44 and the pressing roller 45 are removed.

An evaluation of damage on the linear members 702*b* will be explained next. In the fixing device 700, the linear members 702*b* may be damaged through contact with the recording medium 15. Accordingly, damage on the linear members 702*b* upon abutting against the recording medium 15 was evaluated with an angle θ, a length L1, a length L2, and a transport speed v as parameters. In the evaluation, the following parameters were used; an angle θ of the linear members 702*b* relative to the ideal medium transport plane I; a length L1 of the linear members 702*b* exposed from the thin plate 702*a*; a length L2 of the linear members 702*b* exposed from the thin plate 702*a* to the ideal medium transport plane I; and a transport speed v of the recording medium 15.

It is necessary to prevent damage of the linear members 702*b* for stably obtaining sufficient discharge effect relative to the recording medium 15. In the evaluation, a difference between the length L1 and the length L2 (L1−L2) represents a length of the linear members 702*b* protruding from the ideal medium transport plane I, and is referred to as a linear member protruding length.

In the evaluation, the transport speed v of the recording medium 15 was set at 93 mm/sec., at which the image forming apparatus transported A4 size sheets in a longitudinal direction thereof at 16 ppm. The recording medium 15 was an A4 size P-type sheet (product of Fuji Xerox) having a weight of 75 g/m$^2$. Before the evaluation, the recording medium 15 was placed under a temperature of 10° C. and a relative humidity of 20%, so that the recording medium 15 was easy to accumulate electric charges.

Figure 18:
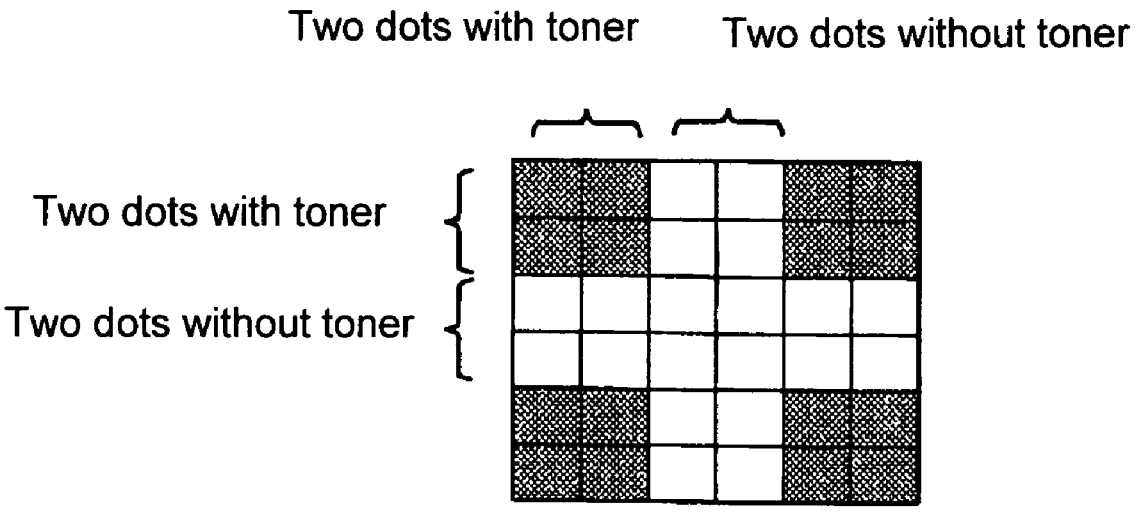
FIG. 18 is a schematic view showing an image pattern used for an evaluation according to the third embodiment of the present invention.

FIG. 18 is a schematic view showing an image pattern used for the evaluation according to the third embodiment of the present invention. Considering that static off-set becomes especially apparent in a half-tone image, the image pattern includes a unit of two dots in a vertical direction and a horizontal direction (total of four dots), and has patterns defining an area with toner and an area without toner (referred to as 2×2 pattern).

In the evaluation, the 2×2 patterns were output with various numbers of the sheets passed through and various linear member protruding lengths (L1−L2). Table 1 shows results of the evaluation. The static off-set is a phenomenon, in which a part of toner incompletely fixed to a recording medium is transferred to a fixing roller through attraction of an electric field generated by frictional charging between the fixing roller and the recording medium, and the part of toner is fixed again to the recording medium upon one rotation of the fixing roller, thereby deteriorating image quality.

TABLE 2

| Number of printed | Linear member protruding length; L1 − L2 (mm) | | | |
|---|---|---|---|---|
| sheets (×1,000) | 0 | 1 | 2 | 3 |
| 0.5 | Fair | Good | Good | Good |
| 20 | Poor | Fair | Good | Good |
| 40 | Poor | Fair | Good | Good |
| 60 | Poor | Poor | Good | Good |

In the evaluation, the 2×2 pattern printed on the recording medium 15 was visually inspected to determine whether a streak occurred in the image. A result was categorized in three levels. When the image did not have a streak, the static off-set was suppressed and it was considered as "good". When the image did have a slight streak and the image was within an acceptable level as a whole, it was considered as "fair". When the image did have a streak and an apparent density difference was visible, it was considered as "poor".

As shown in Table 1, when the linear member protruding length was larger than 2.0 mm, no streak was observed (good) regardless of the numbers of printed sheets, indicating that the static off-set was sufficiently suppressed. In contrast, when the linear member protruding length was 0 mm, even when 500 sheets were printed, a slight streak was visible (poor).

Further, when the linear member protruding length was smaller than 2.0 mm, the apparent density difference became visible (poor) after 60,000 of the sheets were printed, thereby confirming insufficient discharge effect. When the linear member protruding length was smaller than 2.0 mm, the distal ends of the discharging brush 702 tangled to widen and were damaged, thereby decreasing an extent of contact of the discharging brush 702 with respect to the recording medium 15. From the results of the evaluation, it is found that when the linear member protruding length is larger than 2.0 mm, it is possible to effectively prevent the static off-set.

Figure 19:
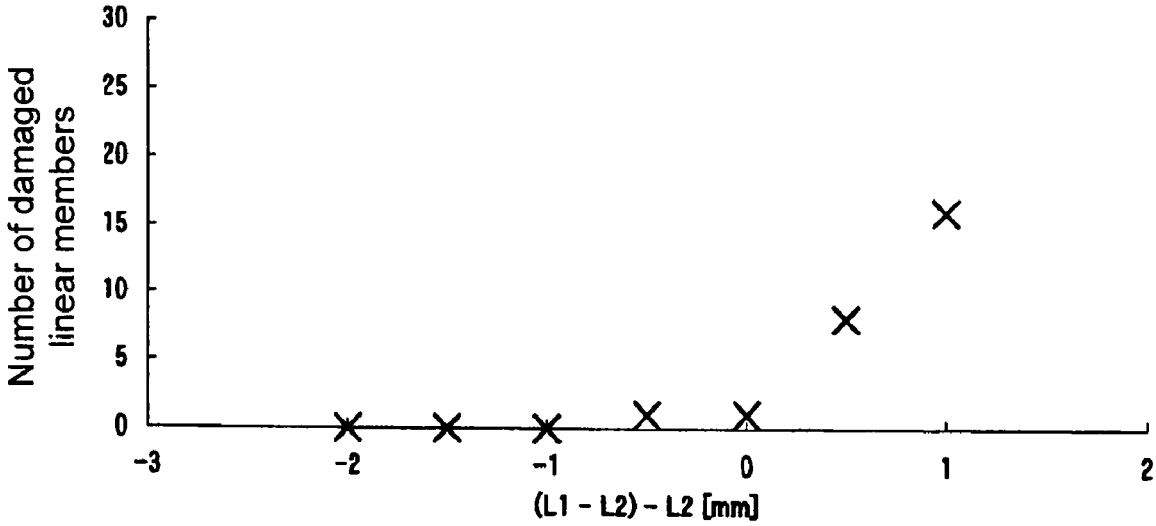
FIG. 19 is a graph showing a relationship between a length of a linear member and the number of damaged linear members according to the third embodiment of the present invention.

FIG. 19 is a graph showing a relationship between a protruding length of the linear members 702*b* and the number of damaged linear members according to the third embodiment of the present invention. The relationship was determined as follows. While the linear member protruding length (L1−L2) was maintained constant at 3.0 mm, the length L2 of the linear members 702*b* exposed from the thin plate 702*a* to the ideal medium transport plane I was changed. After one thousand sheets were printed, the number of damaged linear members 702*b* bent was determined.

As shown in FIG. 19, when a difference between the linear member protruding length and the length L2 ((L1−L2)−L2) is smaller than zero, the number of damaged linear members 702*b* becomes almost zero. This is because, as the difference decreases, the linear members 702*b* tend to deform gently, thereby decreasing a stress generated in the linear members 702*b*. In contrast, when a difference between the linear member protruding length and the length L2 ((L1−L2)−L2) is larger than zero, the linear members 702*b* tend to deform more aggressively, thereby increasing a stress generated in the linear members 702*b* and the number of linear members 702*b* bent.

In the evaluation described above, the linear member protruding length (L1−L2) was maintained constant at 3.0 mm. In a different evaluation, it was found that when the linear member protruding length (L1−L2) was maintained equal to or larger than 2.0 mm and smaller than 5.0 mm, a result similar to that described above was obtained.

From the results described above, it is concluded that when the following conditions are met, it is possible to minimize the static off-set without damaging the linear members 702*b*. The linear member protruding length (L1−L2) is maintained equal to or larger than 2.0 mm and smaller than 5.0 mm ($2.0 \leqq (L1-L2) \leqq 5.0$), and the difference between the linear member protruding length and the length L2 ((L1−L2)−L2) is smaller than zero ($((L1-L2)-L2)<0$).

Figure 20:
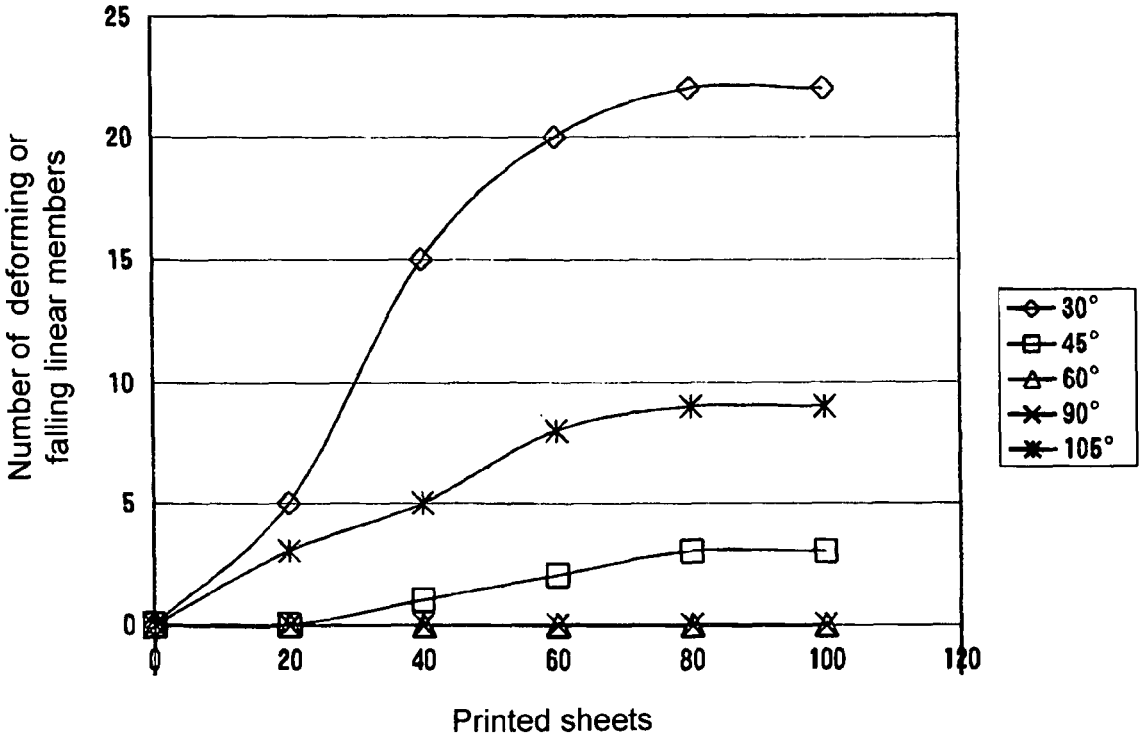
FIG. 20 is a graph showing a relationship between the number of printed sheets and the number of the damaged linear members at various inclination angles of the discharging brush according to the third embodiment of the present invention.

An optimum range of the angle θ of the linear members 702*b* is determined through an evaluation described below. FIG. 20 is a graph showing a relationship between the number of printed sheets and the number of damaged linear members at various angles of the discharging brush 702 according to the third embodiment of the present invention. In FIG. 20, a result shows the relationship between the number of printed sheets and the number of damaged linear members at the various angles of the discharging brush 702 with respect to the ideal medium transport plane I.

In the evaluation, the linear member protruding length (L1−L2) was 3.0 mm, and the length L2 of the linear members

702*b* exposed from the thin plate 702*a* to the ideal medium transport plane I was 7.0 mm (((L1−L2)−L2)=−4.0 mm<0).

As shown in FIG. 20, when the angle θ of the discharging brush 702 was 30° and the number of printed sheets was small (for example, 20,000 sheets), only five of the linear members 702*b* bent toward the fixing roller 44, thereby minimizing an influence on the discharge effect. This is because the linear member 702*b* easily returned to original postures through elasticity thereof. When the number of printed sheets became 80,000 sheets, twenty of the linear members 702*b* bent toward the fixing roller 44. Accordingly, as opposed to the case that all of thirty one of the linear members 702*b* contact without bending, a smaller number of the linear members 702*b* contacted with the recording medium 15, thereby significantly deteriorating the discharge effect.

Similarly, when the angle θ of the discharging brush 702 was 105°, the number of the linear members 702*b* bending toward the downward side in the transportation direction of the recording medium 15 increased as the number of printed sheets increased. Accordingly, a smaller number of the linear members 702*b* contacted with the recording medium 15, thereby significantly deteriorating the discharge effect.

In contrast, when the angle θ of the discharging brush 702 was within a range between 45° and 90°, less than four of the linear members 702*b* bent toward the fixing roller 44 or toward the downward side in the transportation direction of the recording medium 15. Accordingly, almost all of the linear members 702*b* contacted with the recording medium 15, thereby minimizing an influence on the discharge effect. In this case, it was possible to form an image with high quality on the recording medium 15.

Note that the angle θ of the discharging brush 702 has an influence on the transport speed v of the recording medium 15. In the evaluation described above, the transport speed v of the recording medium 15 was set at 93 mm/sec., at which the image forming apparatus transported A4 size sheets in a longitudinal direction thereof at 16 ppm.

In another evaluation, it was found that when the transport speed v of the recording medium 15 was equal to or smaller than 174 mm/sec., at which the image forming apparatus transported A4 size sheets in a longitudinal direction thereof at less than 30 ppm, a result similar to that described above was obtained. Accordingly, when the transport speed v is equal to or smaller than 174 mm/sec., it is concluded that the optimum range of the angle θ of the linear members 702*b* is between 45° and 90°.

As described above, in the embodiment, when the following equations are satisfied, it is possible to minimize the static off-set without damaging the linear members 702*b*, thereby improving the discharge effect and forming an image with high quality on the recording medium 15.

$$2.0\ \text{mm} \leqq (L1-L2) \leqq 5.0\ \text{mm}$$

$$((L1-L2)-L2)<0$$

$$45° \leqq \theta \leqq 90°$$

$$v \leqq 174\ \text{mm/sec.}$$

wherein (L1−L2) is the linear member protruding length; L2 is the length of the linear members 702*b* exposed from the thin plate 702*a* to the ideal medium transport plane I; θ is the angle of the discharging brush 702; and v is the transport speed of the recording medium 15.

Fourth Embodiment

A fourth embodiment of the present invention will be explained next. In the fourth embodiment, a fixing roller and a pressing roller having large diameters are provided. Further, the pressing roller is formed of a hollow roller, and a halogen heater as a heat source is provided in the pressing roller. Further, a discharge brush is provided on a separation member for separating the recording medium.

A configuration in the fourth embodiment is similar to that in the third embodiment, except that a case member has a different size, and it is necessary to provide an attaching member for attaching the separation member to the case member. Components in the fourth embodiment similar to those in the third embodiment are designated with the same reference numerals, and explanations thereof are omitted. Further, explanations of operations and effects in the fourth embodiment similar to those in the third embodiment are omitted.

Note that a configuration shown in FIG. 2 is not adopted for a duplex printing. In the case of the duplex printing, a configuration may be arranged such that the recording medium is turned over after one side of the recording medium is printed. Then, the recording medium is transported to the image forming units for printing on the other side of the recording medium for transferring and fixing. Such a configuration has been known well, and an explanation thereof is omitted.

Figure 21:
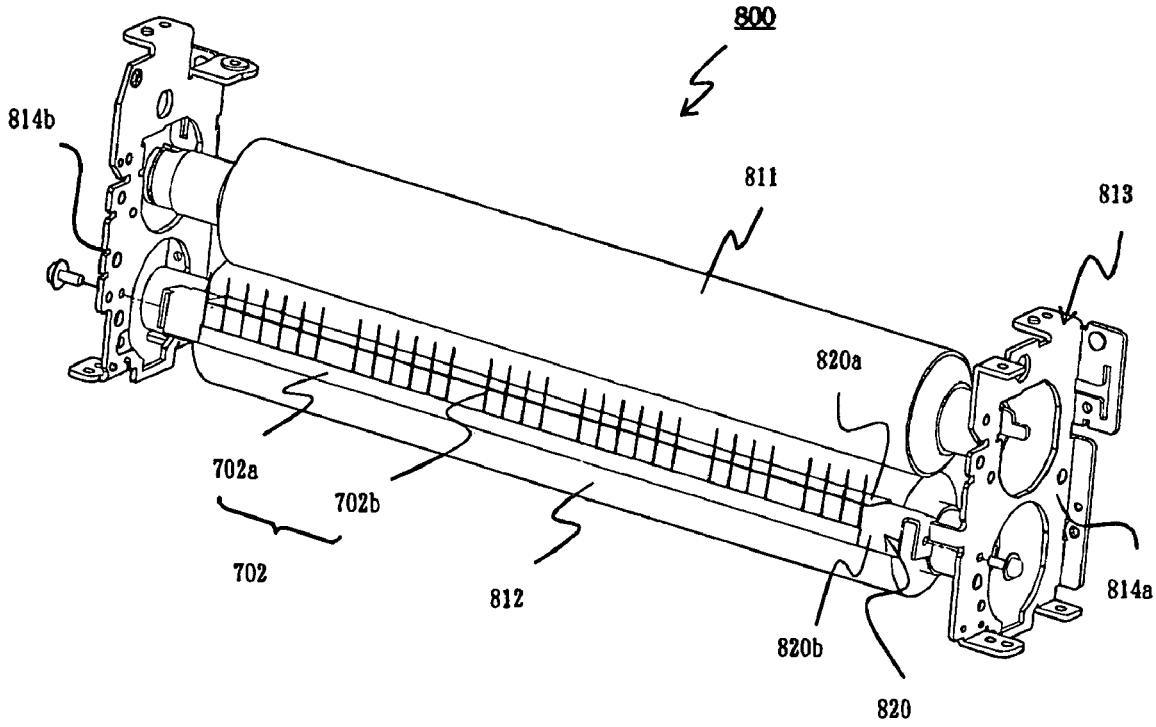
FIG. 21 is a perspective view showing a fixing device according to a fourth embodiment of the present invention.
Figure 22:
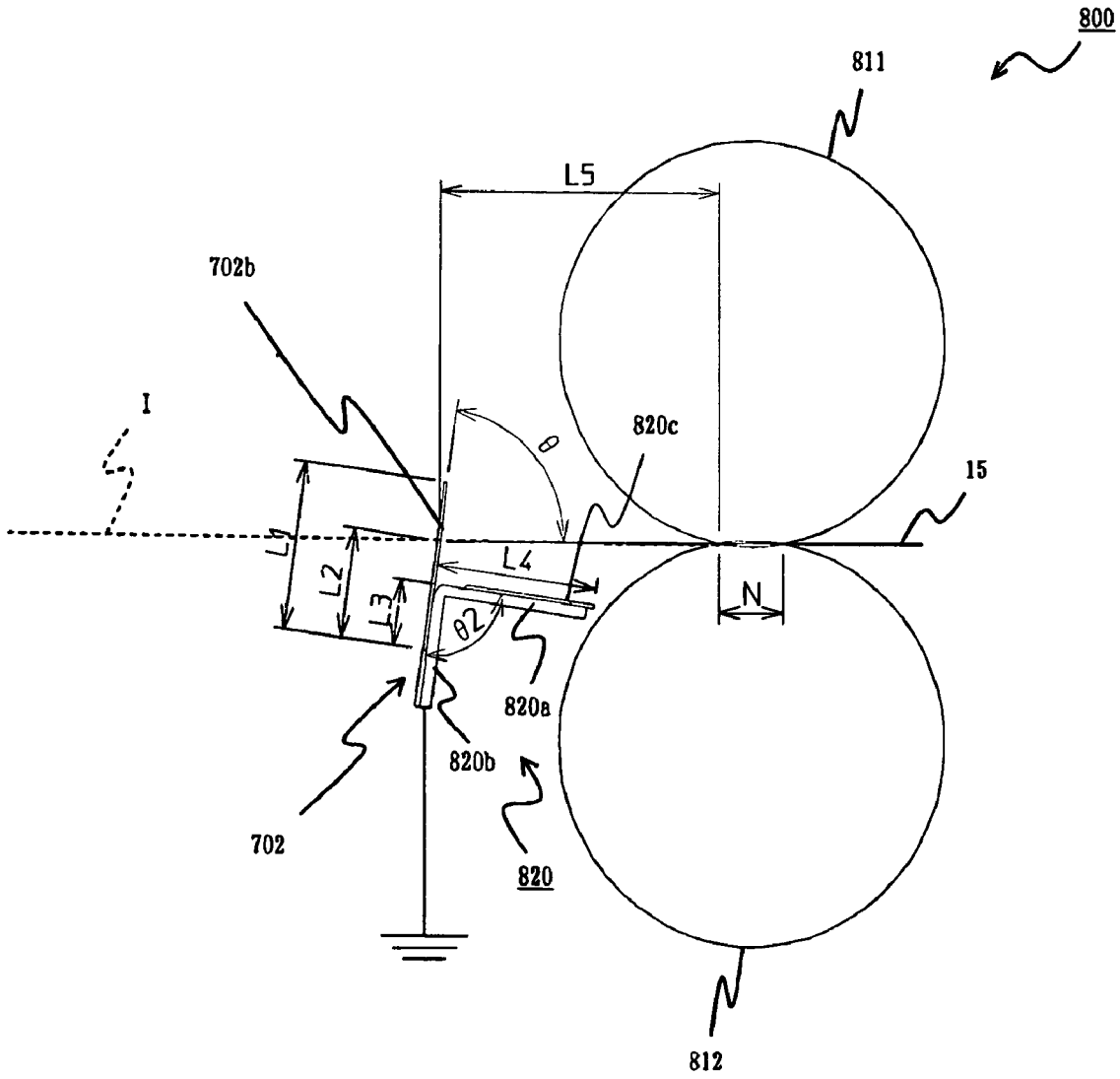
FIG. 22 is a schematic side view of the fixing device according to the fourth embodiment of the present invention.
Figure 23:
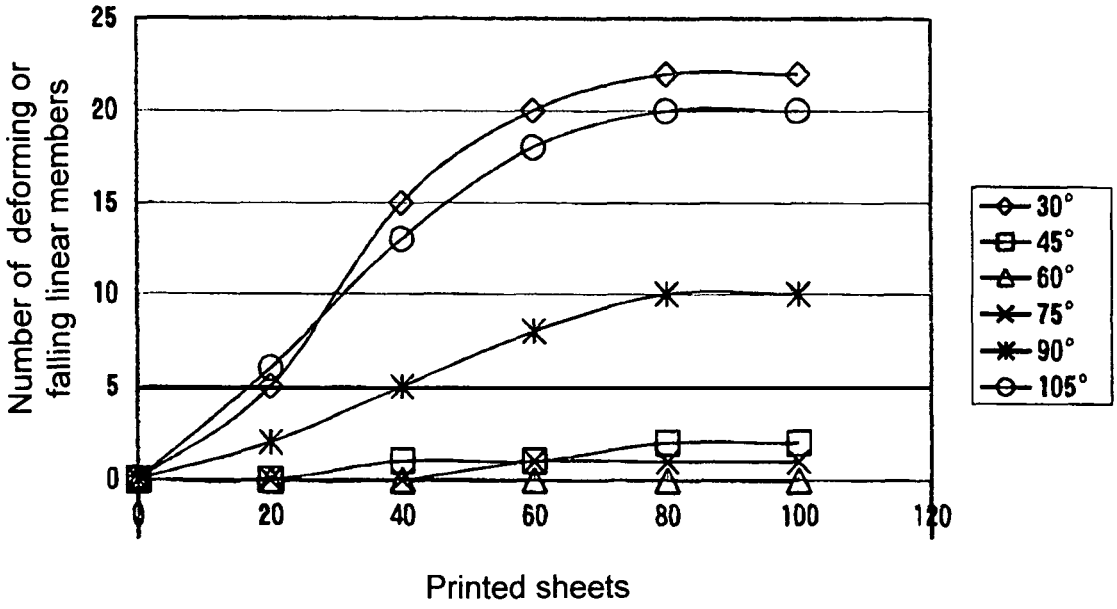
FIG. 23 is a graph showing a relationship between the number of printed sheets and the number of damaged linear members at various inclination angles of a discharging brush according to the fourth embodiment of the present invention.

FIG. 21 is a perspective view showing a fixing device according to the fourth embodiment of the present invention. FIG. 22 is a schematic side view of the fixing device according to the fourth embodiment of the present invention. FIG. 23 is a graph showing a relationship between the number of printed sheets and the number of damaged linear members at various inclination angles of a discharging brush according to the fourth embodiment of the present invention.

As shown in FIGS. 21 and 22, a fixing device 800 includes a fixing roller 811 and a pressing roller 812. When a pressing device (not shown) presses the pressing roller 812 against the fixing roller 811, a nip portion N is formed between the fixing roller 811 and the pressing roller 812 for fixing the toner image T in an unfixed state to the recording medium 15.

In the embodiment, the fixing roller 811 is formed of a hollow roller having an outer diameter of about 36 mm. In the fixing roller 811, a core metal portion made of aluminum having a thickness of about 1.5 mm is covered with an elastic layer with high temperature resistance made of a silicone rubber and having a thickness of about 1.5 mm. Further, an outer circumferential surface of the fixing roller 811 is coated with a fluorine resin layer as a release layer having a thickness of 30 μm. The core metal portion may be formed of a metal other than aluminum. The fixing roller 811 is formed of aluminum, and may be formed of other metal materials such as iron. A halogen heater (not shown) is disposed in the fixing roller 811 as a heat source.

In the embodiment, the pressing roller 812 is formed of a hollow roller having an outer diameter of about 36 mm. In the pressing roller 812, a core metal portion made of aluminum having a thickness of about 1.5 mm is covered with an elastic layer with high temperature resistance made of a silicone rubber foam and having a thickness of about 1.5 mm. Further, an outer circumferential surface of the pressing roller 812 is coated with a fluorine resin layer as a release layer having a thickness of 30 μm. A halogen heater (not shown) is disposed in the pressing roller 812 as a heat source.

In the embodiment, the pressing roller 812 and the fixing roller 811 have diameters large than those in the first to third embodiments. Accordingly, it is possible to deal with an operation at a higher speed.

In the embodiment, the fixing roller 811 and the pressing roller 812 are attached to an attaching member 813 to be attached to a case member (not shown). The attaching member 813 includes sidewall portions 814*a* and 814*b* formed of an insulating material and a separation member 820 formed of an insulating material and fixed between the sidewall portions 814*a* and 814*b*. The separation member 820 is provided for separating the recording medium 15 when the recording medium 15 is stick to the pressing roller 812 having a small curvature.

As shown in FIG. 22, the separation member 820 is formed of a steel plate having a thickness of 1.0 mm and bent in an L-character shape (referred to as an L-character curved plate). Further, the separation member 820 includes a separation portion 820*a* situated at a position facing the recording medium 15 and an inclined portion 820*b* inclined toward the fixing roller 811 with a specific angle θ relative to the ideal medium transport plane I.

In the embodiment, the separation portion 820*a* has a surface attached to a plate portion 820*c* formed of stainless steel with spot welding on a side of the ideal medium transport plane I. A fluorine resin layer having a thickness of 20 μm is formed on a surface of the plate portion 820*c* for separating toner. The plate portion 820*c* is arranged such that a distal end thereof is away from the pressing roller 812 by a distance of 1.0 mm.

In the embodiment, the discharging brush 702 is attached to the separation member 820 with a conductive double-sided tape on a side of the ideal medium transport plane I. The discharging brush 702 includes the linear members 702*b* extending along the inclined portion 820*b* of the separation member 820 and protruding toward the ideal medium transport plane I of the recording medium 15. Similar to the first to third embodiments, the discharging brush 702 is grounded to a metal frame of the image forming apparatus as a grounding member through the separation member 820 and the sidewall portions 814*a* and 814*b*.

As shown in FIG. 22, it is arranged such that the linear members 702*b* are protruded from the thin plate 702*a* by a length L3 of 6.0 mm contacting with the inclined portion 820*b*; the distal end portions of the linear members 702*b* are away from the plate portion 820*c* by a length L4 of 15.0 mm; a distance L5 between an end portion of the nip portion N at a downstream side and the linear members 702*b* is 26.0 mm; and an angle θ2 between the separation portion 820*a* and the inclined portion 820*b* becomes 90°.

An operation of the fixing device 800 will be explained next. As described above, the fixing roller 811 and the pressing roller 812 have the diameters larger than those of the fixing rollers and the pressing rollers in the first to third embodiments. Accordingly, the fixing roller 811 nips the recording medium 15 with an increased nip amount. In the case of the duplex printing, a toner image is formed on a surface of the recording medium 15 contacting with the pressing roller 812 as well. Accordingly, the recording medium 15 tends to stick to the pressing roller 812 upon passing through the nip portion N. When the diameter of the pressing roller 812 increases, and a curvature of the circumferential surface thereof decreases, it is difficult to separate the recording medium 15 from the pressing roller 812 spontaneously.

In the embodiment, as described above, the plate portion 820*c* of the separation member 820 is away from the pressing roller 812 by a distance of 1.0 mm. Accordingly, the plate portion 820*c* is inserted between a front edge of the recording medium 15 and the pressing roller 812, thereby separating the recording medium 15 from the pressing roller 812. After the recording medium 15 is separated from the pressing roller 812, the recording medium 15 is sequentially pushed toward the downstream side. An operation of contacting and discharging the recording medium 15 with the discharging brush 702 is similar to that in the third embodiment.

An evaluation of the fourth embodiment will be explained next. In the evaluation, the transport speed v of the recording medium 15 was set at 231 mm/sec., at which the image forming apparatus transported A4 size sheets in a longitudinal direction thereof at 40 ppm. The recording medium 15 and the patterns (2×2 patterns) printed on the recording medium 15 were same as those in the third embodiment.

From the evaluation similar to that in the third embodiment except the transport speed of the recording medium 15, it is concluded that when the following conditions with respect to (L1−L2) and ((L1−L2)−L2) are satisfied, it is possible to obtain a good result.

$$2.0\ \text{mm} \leqq (L1-L2) \leqq 5.0\ \text{mm}$$

$$((L1-L2)-L2)<0$$

An optimum range of the angle θ of the linear members 702*b* is determined through evaluation described below. As shown in FIG. 23, when the angle θ of the discharging brush 702 is 30°, the linear members 702*b* start bending toward the plate portion 820*c*. Similarly, when the angle θ of the discharging brush 702 is 90° and 105°, the linear members 702*b* bend toward the discharge direction. It is supposed that this is because the recording medium 15 is discharged at a higher speed as opposed to the third embodiment, the discharging brush 702 receives a larger load.

Accordingly, from the results of the evaluation, when the angle θ of the linear members 702*b* is between 45° and 75°, it is possible to minimize the bending of the discharging brush 702 toward the pressing roller 812 or the downstream side in the transportation direction of the recording medium 15, thereby obtaining sufficient discharge effect.

Note that the angle θ of the discharging brush 702 has an influence on the transport speed v of the recording medium 15. In the evaluation described above, the transport speed v of the recording medium 15 was set at 231 mm/sec., at which the image forming apparatus transported A4 size sheets in a longitudinal direction thereof at 40 ppm.

In another evaluation, it was found that when the transport speed v of the recording medium 15 was larger than 174 mm/sec. and equal to or smaller than 347 mm/sec., at which the image forming apparatus transported A4 size sheets in a longitudinal direction thereof at less than 60 ppm, a result similar to that described above was obtained.

Accordingly, when the transport speed v is larger than 174 mm/sec. and equal to or smaller than 347 mm/sec., the optimum range of the angle θ of the linear members 702*b* is between 45° and 75°.

As described above, in the embodiment, when the following equations are satisfied, it is possible to minimize the static off-set without damage such as bending of the linear members 702*b*, and to minimize the bending of the discharging brush 702 toward the pressing roller 812 or the downstream side in the transportation direction of the recording medium 15, thereby maintaining the linear members 702*b* for the discharge effect and preventing improper transportation of the recording medium 15 such as improper stacking.

$$2.0\ \text{mm} \leqq (L1-L2) \leqq 5.0\ \text{mm}$$

$$((L1-L2)-L2)<0$$

$$45° \leqq \theta \leqq 75°$$

$$174\ \text{mm/sec.} < v \leqq 347\ \text{mm/sec.}$$

wherein (L1–L2) is the linear member protruding length; L2 is the length of the linear members 702*b* protruded from the thin plate 702*a* to the ideal medium transport plane I; e is the angle of the discharging brush 702; and v is the transport speed of the recording medium 15.

Fifth Embodiment

A fifth embodiment of the present invention will be explained next. Components in the fifth embodiment similar to those in the fourth embodiment are designated with the same reference numerals, and explanations thereof are omitted. Further, explanations of operations and effects in the fifth embodiment similar to those in the fourth embodiment are omitted.

Figure 24:
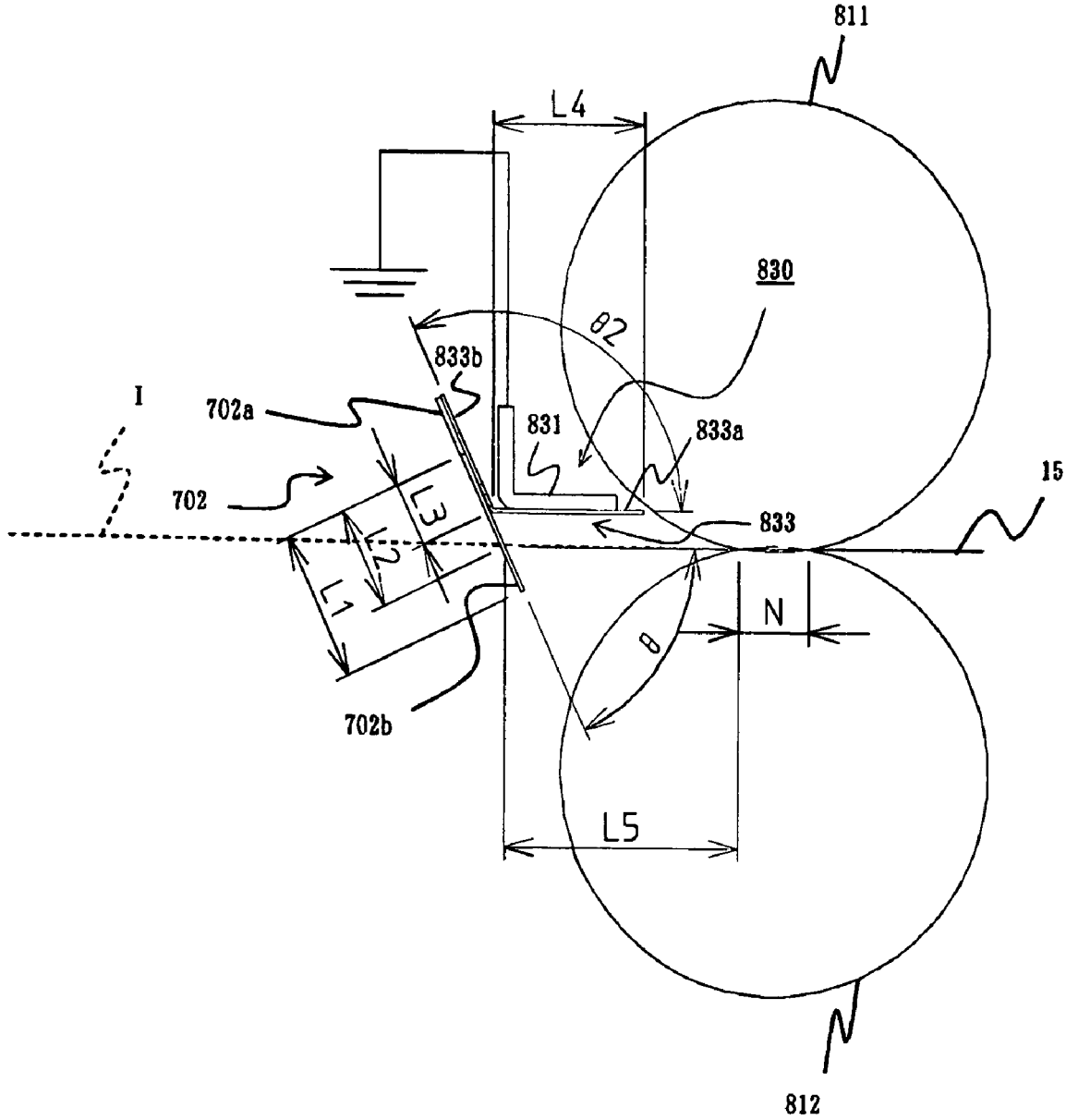
FIG. 24 is a schematic side view showing a fixing device according to a fifth embodiment of the present invention.

FIG. 24 is a schematic side view showing a fixing device according to the fifth embodiment of the present invention. In the fifth embodiment, as compared with the fourth embodiment, a separation member 830 is disposed on the side of the fixing roller 811.

In the embodiment, the separation member 830 includes a curved member 831 curved in an L-character shape and having a thickness of 1.0 mm and a plate member 833 formed of stainless steel and having a thickness of 0.3 mm. The plate member 833 is fixed to the curved member 831 with a spot welding on a side of the ideal medium transport plane I.

In the embodiment, the plate member 833 includes a horizontal portion 833*a* extending toward the fixing roller 811 in parallel to the direction that the recording medium 15 is transported, and an inclined portion 833*b* extending away from the ideal medium transport plane I in an inclined state inclined by a specific angle θ2 on a downstream side of the horizontal portion 833*a* in the direction that the recording medium 15 is transported.

In the embodiment, a fluorine resin layer having a thickness of 20 μm is formed on a surface of the horizontal portion 833*a* for separating toner. Further, the discharging brush 702 is disposed on the inclined portion 833*b* on a side thereof facing the ideal medium transport plane I, so that the liner members 702*b* extend along the inclined portion 833*b* and protrude toward the ideal medium transport plane I. Similar to the embodiments described above, the discharging brush 702 is grounded to the metal frame of the image forming apparatus as the grounding member.

An evaluation of the fifth embodiment will be explained next. In the evaluation, the transport speed v of the recording medium 15 was set between 174 mm/sec. and 347 mm/sec. (174 mm/sec.<v≦347 mm/sec.), at which the image forming apparatus transported A4 size sheets in a longitudinal direction thereof at 30 ppm to 60 ppm. The recording medium 15 and the patterns (2×2 patterns) printed on the recording medium 15 were same as those in the fourth embodiment.

As shown in FIG. 24, it is arranged such that the distal end portions of the plate member 833 is away from the fixing roller 811 by a distance of 0.5 mm; the linear members 702*b* protruded from the thin plate 702*a* contact with the inclined portion 833*b* for a length L3 of 7.0 mm; a length L4 of the horizontal portion 833*a* is 13.0 mm; a distance L5 between the end portion of the nip portion N at the downstream side to the linear members 702*b* is 20.0 mm; and an angle θ2 between the horizontal portion 833*a* and the inclined portion 833*b* becomes 115°.

An operation of the fixing device 900 in the fifth embodiment is similar to that in the fourth embodiment. That is, the recording medium 15 tends to stick to the fixing roller 811 upon passing through the nip portion N. The plate member 833 is inserted between the front edge of the recording medium 15 and the fixing roller 811, thereby separating the recording medium 15 from the fixing roller 811. After the recording medium 15 is separated from the fixing roller 811, the recording medium 15 is sequentially pushed toward the downstream side. An operation of contacting and discharging the recording medium 15 with the discharging brush 702 is similar to that in the fourth embodiment.

In the embodiment, when the following equations are satisfied, it is possible to minimize the static off-set while reducing bending of the linear members 702*b*, thereby obtaining an image with high quality. In particular, the discharging brush 702 directly contacts with the surface of the recording medium 15 for discharging, thereby making it possible to effectively prevent the static off-set upon printing on one side of the recording medium 15. Further, it is possible to minimize the bending of the linear members 702*b* toward the downstream side in the transportation direction of the recording medium 15, thereby maintaining the linear members 702*b* for the discharge effect and preventing improper transportation of the recording medium 15 such as improper stacking.

$$2.0\ \text{mm} \leqq (L1-L2) \leqq 5.0\ \text{mm}$$

$$((L1-L2)-L2)<0$$

$$45° \leqq \theta \leqq 75°$$

$$174\ \text{mm/sec.} < v \leqq 347\ \text{mm/sec.}$$

wherein (L1–L2) is the linear member protruding length; L2 is the length of the linear members 702*b* protruded from the thin plate 702*a* to the ideal medium transport plane I; θ is the angle of the discharging brush 702; and v is the transport speed of the recording medium 15.

Figure 25:
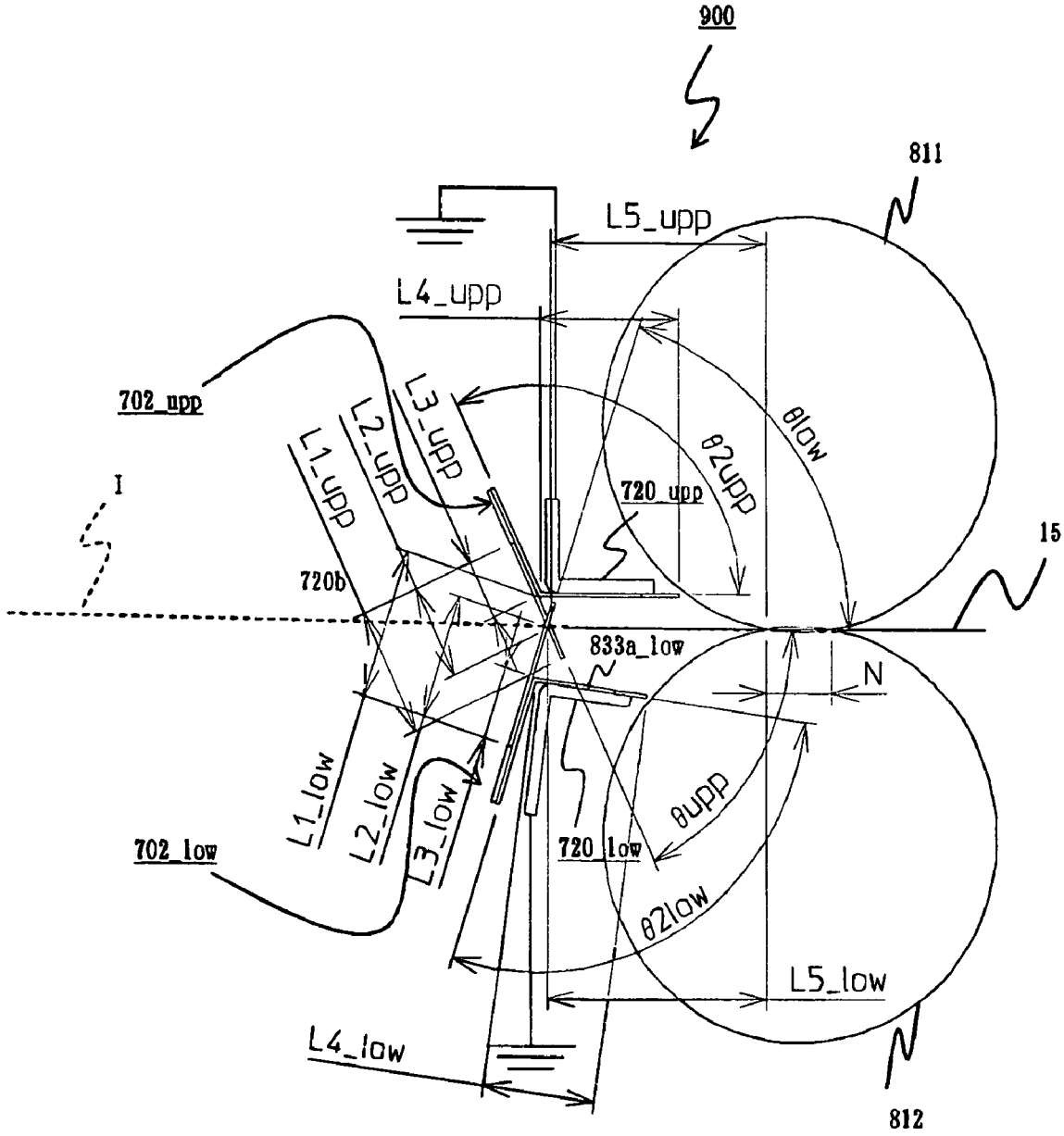
FIG. 25 is a schematic side view showing a modified example of the fixing device according to the fifth embodiment of the present invention.
Figure 26:
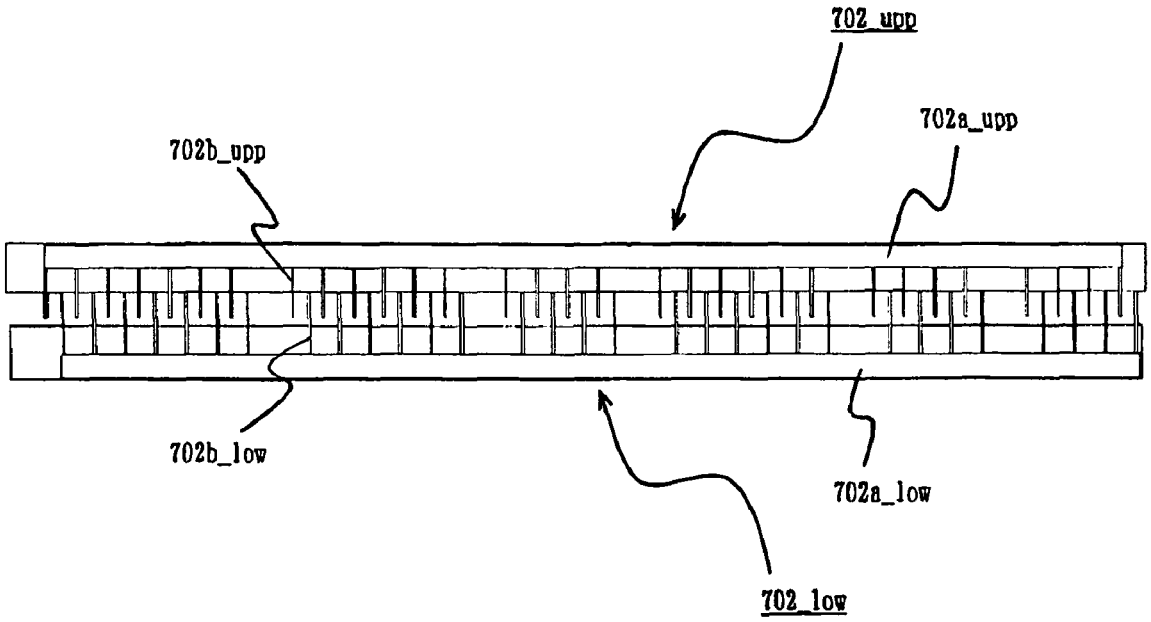
FIG. 26 is a schematic front view of discharging brushes of the modified example of the fixing device according to the fifth embodiment of the present invention.

FIG. 25 is a schematic side view showing a modified example of the fixing device 900 according to the fifth embodiment of the present invention. FIG. 26 is a schematic front view of discharging brushes 702_upp and 702_low of the modified example of the fixing device according to the fifth embodiment of the present invention. In the modified example, as compared with the fifth embodiment, separation members 720_upp and 720_low are provided on the side of the fixing roller 811 and the pressing roller 812, respectively. In addition to the separation members 720_upp and 720_low, the discharging brushes 702_upp and 702_low are provided.

In the modified example, as shown in FIG. 25 and FIG. 26, linear members 702*b*_upp of the discharging brush 702_upp and linear members 702*b*_low of the discharging brush 702_low are arranged alternately along the ideal medium transport plane I, so that the linear members 702*b*_upp do not interfere with the linear members 702*b*_low.

As shown in FIG. 26, it is arranged such that a distance L3_low that linear members 702*b*_low protruded from the thin plate 702*a*_low contact with the lower plate member 833*b*-low is 6.0 mm; a distance L4 of the lower horizontal portion 833*a*_low is 10 mm; and a distance L5 between the nip portion N and the linear members 702*b*_upp and the linear members 702*b*_low is 20.0 mm. Other configuration is same as that in the fifth embodiment. The reference numerals with _ upp denote the components on the side of the fixing roller 811, and the reference numerals with _low denote the components on the side of the pressing roller 812.

An operation of the fixing device 900 in the modified example of the fifth embodiment is similar to those in the fifth embodiment. That is, the recording medium 15 tends to stick to the fixing roller 811 and the pressing roller 812 upon passing through the nip portion N. The plate member 833 is inserted into the front edge of the recording medium 15 having a blank area, thereby separating the recording medium 15 from the fixing roller 811. After the recording medium 15 is separated from the fixing roller 811 and the pressing roller 812, the recording medium 15 is sequentially pushed toward the downstream side.

An operation of contacting and discharging the recording medium 15 with the discharging brush 702_upp and the discharging brush 702_low is similar to that in the fifth embodiment.

In the modified example of the fifth embodiment, when the equations described above are satisfied, it is possible to minimize the static off-set while reducing damage such as bending of the linear members 702*b*_low and 702*b*_upp, thereby obtaining an image with high quality. In particular, the linear members 702*b*_upp and the linear members 702*b*_low directly contact with the both surfaces of the recording medium 15 for discharging, thereby making it possible to effectively prevent the static off-set in the duplex printing.

Further, it is possible to minimize the bending of the linear members 702*b*_upp and the linear members 702*b*_low toward the downstream side in the transportation direction of the recording medium 15 or the bending of the linear members 702*b*_upp and the linear members 702*b*_low toward the fixing roller 811 and the pressing roller 812, thereby maintaining the linear members 702*b*_upp and the linear members 702*b*_low for the discharge effect and preventing improper transportation of the recording medium 15 such as improper stacking.

In the fifth embodiment and the modified example thereof, the separation member is disposed on the downstream side of the fixing roller 811 and the pressing roller 812. The present invention is not limited thereto, and the separation member may be disposed on an upstream side of the pressing roller 812. When the separation member is disposed on the upstream side of the pressing roller 812, it is necessary to provide a resistor between the discharging brush 702 and the case member for adjusting a discharge amount. Before toner on the recording medium 15 is fixed, toner is maintained on the recording medium 15 in a charged state. When the discharging brush 702 completely removes electron charges, the toner image thus formed may be removed as well.

In the third embodiment, the discharging brush 702 is disposed on the attaching member 701*a*. In the fourth and fifth embodiments, the discharging brush 702 is disposed on the separation member. The optimum range of the angle θ of the discharging brush 702 does not depend on the attaching member (the attaching member 701*a* or the separation member).

As described above, when the transport speed v of the recording medium 15 is equal to or smaller than 174 mm/sec. ($v \leqq 174$ mm/sec.), the angle θ of the linear members 702*b* of the discharging brush 702 with respect to the ideal medium transport plane I is set between 45° and 90° ($45° \leqq \theta \leqq 90°$). When the transport speed v of the recording medium 15 is between 174 mm/sec. and 347 mm/sec. (174 mm/sec.$<v \leqq 347$ mm/sec.), the angle θ of the linear members 702*b* of the discharging brush 702 with respect to the ideal medium transport plane I is set between 45° and 75° ($45° \leqq \theta \leqq 75°$). As far as the arrangement is maintained, the present invention is applicable to other embodiments.

In the embodiments described above, the printer is explained as the image forming apparatus 10. The image forming apparatus 10 may include a copier, a facsimile, a Multifunction Peripheral, and the like.

The disclosure of Japanese Patent Application No. 2006-179009, filed on Jun. 29, 2006, is incorporated in the application.

While the invention has been explained with reference to the specific embodiments of the invention, the explanation is illustrative and the invention is limited only by the appended claims.

What is claimed is:

1. A fixing device comprising:

a fixing member for heating a recording medium and fixing an image formed on a front surface of the recording medium;

a pressing member pressed against the fixing member for pressing a backside surface of the recording medium against the fixing member;

a frame member for supporting the fixing member and the pressing member;

a cover member for covering the frame member; and a discharging member for discharging static electricity accumulated on the recording medium from the backside surface, said discharging member being sandwiched and held between the cover member and the frame member, said discharging member being disposed inside the cover member and extending toward the fixing member.

2. The fixing device according to claim 1, wherein said frame member is formed of a conductive material so that the discharging member is grounded through the frame member.

3. The fixing device according to claim 1, wherein said discharging member includes a linear member contacting with the recording medium and a supporting member for supporting the linear member, said supporting member having an end portion sandwiched and held between the cover member and the frame member.

4. The fixing device according to claim 3, wherein said supporting member is attached to the frame member.

5. The fixing device according to claim 3, wherein said frame member is arranged to be away from a medium transport plane passing between the fixing member and the pressing member, said frame member including an inclined portion inclined toward one of the fixing member and the pressing member with respect to the medium transport plane by a specific angle, said supporting member being attached to the inclined portion so that the linear member extends along the inclined portion and crosses the medium transport plane.

6. The fixing device according to claim 5, wherein said inclined portion is disposed on a side of the pressing member with respect to the medium transport plane.

7. The fixing device according to claim 5, wherein said linear member is arranged so that the following equations are satisfied:

$$2.0 \text{ mm} \leqq (L1-L2) \leqq 5.0 \text{ mm}$$

$$((L1-L2)-L2)<0$$

wherein L1 is a length of the linear member protruding from the supporting member, and L2 is a distance from a position of the linear member protruding from the supporting member to the medium transport plane.

8. The fixing device according to claim 7, wherein said inclined portion is arranged so that the following equation is satisfied:

$$45° \leqq \theta \leqq 90°$$

wherein θ is an angle of the inclined portion with respect to the medium transport plane, and a speed v that the recording medium is transported is satisfied the following equation:

$$v \leqq 174 \text{ mm/sec.}$$

9. The fixing device according to claim 7, wherein said inclined portion is arranged so that the following equation is satisfied:

$$45° \leqq \theta \leqq 75°$$

wherein θ is an angle of the inclined portion with respect to the medium transport plane, and a speed v that the recording medium is transported is satisfied the following equation:

$$174 \text{ mm/sec.} < v \leqq 347 \text{ mm/sec.}$$

10. The fixing device according to claim 5, wherein said inclined portion includes a guide member contacting with the recording medium for guiding the recording medium.

11. The fixing device according to claim 10, wherein said linear member is disposed each of a plurality of locations except in an area overlapping with the guide member.

12. An image forming apparatus comprising the fixing device according to claim 1.

13. The fixing device according to claim 1, wherein said discharging member is arranged so that a distal end portion crosses a path of the recording medium.

14. The fixing device according to claim 1, wherein said discharging member is arranged to extend in an inclined state by a specific angle relative to the recording medium.

15. The fixing device according to claim 1, wherein said discharging member is arranged on a downstream side of the fixing member in a direction that the recording medium is transported.

* * * * *